US005187051A

United States Patent [19]

Ishikawa

[11] Patent Number: 5,187,051

[45] Date of Patent: Feb. 16, 1993

[54] METHOD FOR PROCESSING A SILVER HALIDE COLOR PHOTOGRAPHIC MATERIAL

[75] Inventor: Takatoshi Ishikawa, Minami-ashigara, Japan

[73] Assignee: Fuji Photo Film Co., Ltd., Kanagawa, Japan

[21] Appl. No.: 647,127

[22] Filed: Jan. 29, 1991

[30] Foreign Application Priority Data

Jan. 29, 1990 [JP] Japan ..... 2-18391

[51] Int. Cl.[5] ..... G03C 1/71

[52] U.S. Cl. ..... 430/448; 430/490; 430/498; 430/523; 430/524; 430/531; 430/950

[58] Field of Search ..... 430/434, 448, 467, 490, 430/498, 523, 524, 525, 531, 950

[56] References Cited

U.S. PATENT DOCUMENTS 5,028,517 7/1991 Kuse et al. ..... 430/467

FOREIGN PATENT DOCUMENTS 312984 4/1989 European Pat. Off. .
327768 8/1989 European Pat. Off. ..... 430/950
337490 10/1989 European Pat. Off. ..... 430/950
387015 9/1990 European Pat. Off. ..... 430/950
1105948 4/1989 Japan .
1116639 5/1989 Japan .
1130156 5/1989 Japan ..... 430/950
1302351 12/1989 Japan .
1302352 12/1989 Japan .

*Primary Examiner*—Hoa Van Le
*Attorney, Agent, or Firm*—Sughrue, Mion, Zinn, Macpeak & Seas

[57] ABSTRACT

There is disclosed a method for processing a silver halide photographic material comprising processing the silver halide color photographic material containing a prescribed amount of titanium oxide in an water-resistant resin layer on the silver halide color photographic material, with a color developer containing a prescribed amount of chloride ions. The disclosure described provides a method of developing processing wherein edge stain due to penetration of a developing solution from the cut end of the base is prevented and the sharpness of image is excellent.

17 Claims, No Drawings

METHOD FOR PROCESSING A SILVER HALIDE COLOR PHOTOGRAPHIC MATERIAL

FIELD OF THE INVENTION

The present invention relates to a method for processing silver halide color photographic materials, and more particularly to a development processing method wherein edge stain due to penetration of the developing processing solution from the cut end of the base is prevented and the sharpness of image is excellent.

BACKGROUND OF THE INVENTION

Although conventionally, as a photographic reflecting base, so-called baryta paper, comprising paper whose one surface is coated with a baryta layer made up mainly of barium sulfate, has been used, recently a waterproof base, wherein both surfaces of the base paper are coated with a resin, is now being used in order to simplify and quicken the development processing. However, even if such a waterproof base is used, penetration of the development processing solution from the cut end of the base cannot be prevented. The development processing solution that has penetrated from the cut end cannot be removed by short-period processing and it turns brown due to heat or aging, resulting in stain at the edges of the photograph, which greatly, spoils the value of the photograph. In order to prevent such edge stain, measures of giving a high sizing property to the raw paper layer are attempted.

Although, for example, fatty acid soap type sizing agents, as disclosed in JP-B ("JP-B" means examined Japanese patent publication) No. 26961/1972, and alkylketene dimers, as disclosed in JP-A ("JP-A" means unexamined published Japanese patent application) No. 132822/1976, are used as sizing agents for photographic raw paper, they have defects and are unsatisfactory. That is, fatty acid type sizing agents have such defects that they are low in sizing effect against the alkalis in developers and the strength of the paper is lowered extremely, and the stiffness of the paper decreases as the amount of the sizing agents is increased. On the other hand, in the case of alkylketene dimers, although they are good in sizing property against water, they have defects that the sizing property against alkaline water and water containing such organic solvents such as alcohols is inadequate, and the use of a relatively large amount of polyamidepolyamineepichlorohydrico resin, known as a fixing agent, is required Thus, neither of the sizing agents is sufficiently satisfactory for photographic raw paper.

In recent years, in photographic processing of color photographic materials, along with the shortening of the time for delivery of the finished products and the mitigation of photofinishing lab work, reduction of the processing time, reduction of the replenishing amount of the processing solution, and reduction of the amount of the waste liquor are both desired and already effected in practice in mini-labs or the like, and the practice is being now spread into the market. Solution of the above edge stain problem has been strongly desired while the processing conditions are becoming severe, which include the increase of the processing solution temperature involved in the quick processing, reduction of the washout time, the processing solution involved in reducing the amount of replenishment (coloration of the processing solution or formation of a tarry material thereof), and an increase of the accumulated concentration of materials dissolved out from the photographic material.

It is considered that, in comparison with transmitting bases, silver halide color photographic materials having a reflecting base are apt to scatter light, and generally the sharpness of the image thereon is poor. In particular, in color print materials, the transmitted light from a color film system is shone through a printer. In this case, the sharpness of the image obtained on the final print material is considered conventionally to depend on the sharpness of the color film system, but as the image quality of recent color films is improved, the sharpness of color print materials themselves influences greatly the final image, and as a result improvement in the sharpness of reflecting bases is desired.

Incidentally, up to now, in order to improve the sharpness, for example, improvements of dyes used for the prevention of irradiation have been done. Improvements of dyes are described, for example, in JP-A Nos.145125/1975, 20830/1977, 147712/1975, 111641/1984, 148448/1986, 151538/1986, 151649/1986, 151650/1986, 151651/1986, 170742/1986, 175638/1986, 235837/1986, 248044/1986, 164043/1987, 253145/1987, 253146/1987, 253142/1987, 275262/1987, and 283336/1987 and Research Disclosure RD-17643 (page 22, December 1978) and RD-18716 (page 647, November 1979).

It is also described in JP-A No. 286849/1988 how the optical reflection density is brought to a certain density or more when these diffusible dyes are used.

For these difficulties, improvements in bases have also been studied. Although baryta paper has been used as a base for color print photographic materials hitherto, water-resistant bases are recently used, wherein both surfaces of the raw paper are laminated with polyethylene for the purpose of quickening the development processing. In such water-resistant bases, titanium oxide or zinc oxide is dispersed in the polyethylene layer in order to bring the sharpness of the print image to the level of that of baryta paper, but actually the level of the sharpness of the print image thereof is far from that of baryta paper conventionally used. Therefore, improvements of polyethylene layers containing titanium oxide are described, for example, in JP-B No. 43734/1983 and JP-A Nos. 17433/1983, 14830/1983, and 259246/1986.

Techniques for providing water-resistant resin layers on raw paper by applying on the raw paper a coating liquid containing a white pigment and an unsaturated organic compound having one or more double bonds in the molecule capable of being polymerized with an electron ray, and hardening the coating liquid by irradiation with the electron ray while heating the coating liquid are described, for example, in JP-A Nos. 27257/1982, 49946/1982, 262738/1986, and 61049/1987.

Silver halide photographic materials that use a mirror reflective or second-kind diffusion reflective base are also known and are described, for example, in JP-A Nos. 24251/1988 and 24253/1988.

However, improving only bases cannot meet the need for higher improved sharpness and development of further improved techniques is needed.

SUMMARY OF THE INVENTION

Therefore, the object of the present invention is to provide a development processing method wherein edge stain due to penetration of the developing processing solution from the cut end of the base is prevented and the sharpness of image is excellent.

Other and further objects, features, and advantages of the invention will appear more fully from the following description.

DETAILED DESCRIPTION OF THE INVENTION

The object of the present invention has been effectively accomplished by providing a method for processing a silver halide color photographic material having at least one silver halide photosensitive layer on a reflective base whose substrate is coated with a water-resistant resin layer, which comprises processing the silver halide color photographic material containing titanium oxide particles in a concentration of 14 wt. % or more in the water-resistant resin layer on the side where the silver halide photosensitive layer is applied, with a color developer containing chloride ions in an amount of 0.035 to 0.3 mol/l.

The feature of the base in the present invention lies in that titanium oxide fine particles are dispersed in a water-resistant resin layer in a concentration of more than 14 wt. %, and preferably on the order of down to 15 wt. % and up to 60 wt. %. Although the particle size of titanium oxide fine particles is not restricted, preferably the particle diameter of titanium oxide fine particles is in a range of 0.01 to 1.0 μm. Preferably the surface of fine particles of the titanium oxide pigment is treated with a bivalent to tetravalent alcohol, such as 2,4-dihydroxy-2-methylpentane or trimethylolethane, as described, for example, in JP-A No. 17151/1983, together with or separately from an inorganic oxide such as silica or aluminum oxide.

The water-resistant resin containing titanium oxide fine particles is used to form a layer having a thickness of 2 to 200 μm, and preferably 5 to 80 μm. The water-resistant resin layer containing titanium oxide fine particles of the present invention may be laminated, for example, together with water-resistant resin layers wherein the content of the titanium oxide fine particles varies, or together with water-resistant layers that contain other white pigment or do not contain any white pigment. In that case, preferably the present water-resistant resin layer containing titanium oxide fine particles is placed at a position away from the base (at a position nearer to the silver halide emulsion layer).

In the present invention, the deviation coefficient of the occupation area rate (%) of the white pigment fine particles in the water-resistant resin layer is preferably 0.20 or below, more preferably 0.15 or below, and particularly preferably 0.10 or below.

The dispersibility of the white pigment fine particles in the resin layer can be assessed from the deviation coefficient of the occupation area rate (%) by spattering the resin layer surface or the resin layer to the depth of about 0.1 μm, and preferably to about 500 Å, by the ion spattering technique by glow discharge and by observing the exposed pigment fine particles under an electron microscope to find the photographed occupation area. The ion spattering technique is described in detail, for example, by Yoichi Murayama and Kunihiro Kashiwagi in *Surface Treatment Technique Using Plasma,* Kikaino Kenkyu, Vol. 33, 6 (1981).

To control the deviation coefficient of the occupation area rate of the white pigment particles to 0.20 or below, it is good to knead sufficiently the white pigment in the presence of a surface-active agent, and it is also preferable to use pigment particles whose surface has been treated with the previously mentioned bivalent to tetravalent alcohol.

The occupation area rate (%) per specified unit area of the white pigment fine particles can be determined by sectioning the most representatively observed area into contiguous unit areas of 6 μm×6 μm and measuring the occupation area rate (%) (Ri) of the fine particles projected on the unit areas. The deviation coefficient of the occupation area rate (%) can be found from the ratio $s/\bar{R}$ of the standard deviation s of Ri to the average value ($\bar{R}$) of Ri. The number (n) of the unit areas to be taken is preferably 6 or more. Accordingly, the deviation coefficient $s/\bar{R}$ can be obtained in accordance with $$\sqrt{\frac{\sum_{i=1}^{n}(Ri-\bar{R})^2}{n-1}} \Big/ \frac{\sum_{i=1}^{n} Ri}{n}$$

The water-resistant resin can contain a white pigment other than titanium oxide. For example, as preferable white pigments, rutile titanium oxide, anatase titanium oxide, barium sulfate, calcium sulfate, silicon oxide, zinc oxide, titanium phosphate, and aluminum oxide can be used.

The white base used for the silver halide photographic material according to the present invention is one wherein a water-resistant resin layer covers the substrate and as the substrate, raw papers obtained from natural pulp or a synthetic pulp or a mixture thereof, plastic films such as polyester films made, for example, of polyethylene terephthalate or polybutylene terephthalate and cellulose triacetate film, polystyrene film, polypropylene film, and polyolefin film can be used.

The raw paper used in the present invention is selected from materials generally used for photographic paper. That is, use is made of one comprising a main raw material of natural pulp selected, for example, from softwood and hardwood to which is added, as required, for example, filer, such as clay, talc, calcium carbonate, and urea resin fine particles, a sizing agent, such as rosin, an alkylketene dimer, a higher fatty acid, paraffin wax, and an alkenyl succinate, a paper strengthening agent, such as polyacrylamide, and a fixing agent, such as cationic polymers and aluminum sulfate (alum). Particularly preferable one is neutral paper having a pH of 5 to 7 (measured by a pH meter having electrodes of GST-5313F for flat objects, manufactured by Toa Denpa Kogyo KK) wherein a reactive sizing agent such as an epoxidized fatty acid amide, alkylketene dimer, and alkenyl succinate, is used. Further, one made of a synthetic pulp instead of natural pulp can also be used, and one made of natural pulp and a synthetic pulp mixed in an arbitrary ratio can also be used.

The pulp surface may be sized with a skin-forming polymer, such as a gelatin, a starch, a carboxymethylcellulose, a polyacrylamide, a poly(vinyl alcohol), and a poly(vinyl alcohol) modified product. In this case, as the poly(vinyl alcohol) modified product, for example, carboxyl-group-modified products, silanol-modified products, and copolymers with acrylamide can be mentioned. The coating amount of the skin-forming polymer with which the surface sizing treatment is made is adjusted to 0.1 to 5.0 g/m$^2$, and preferably 0.5 to 2.0 g/m$^2$. If necessary, to the skin-forming polymer, for example, an antistatic agent, a brightening agent, a pigment, and an anti-foaming agent can be added.

The raw paper is manufactured by making a pulp slurry comprising the above pulp containing, if necessary, additives, such as a filler, a sizing agent, a paper strengthening agent, and a fixing agent, into paper, and drying and taking up it by a paper machine, such as a Fourdrinter paper machine. The surface sizing treatment is performed either before or after the drying, and then calendering treatment is performed between the drying and taking up. The calendering treatment can be performed either before or after the surface sizing treatment when the surface sizing treatment is performed after the drying.

Whether or not the raw paper used for the base substrate of the present invention is neutral paper is judged by using an electrode, for example, GST-5313F for flat objects, manufactured by Toa Denpa Kogyo KK, to measure the pH value thereof. Neutral paper is one having a pH value of 5 or over, and preferably 5 to 9.

The water-resistant resin layer according to the present invention may itself constitute a base such as vinyl chloride resins.

The term "a water-resistant resin" used in the present invention refers to a water-resistant resin having a water absorption rate of 0.5 (wt. %), and preferably 0.1 or below, and examples thereof include a polyalkylene (e.g., polyethylene, polypropylene, and their copolymers), a vinyl polymer and its copolymer (e.g., polystyrene, polyacrylate, and their copolymers), and a polyester and its copolymer. Preferably, polyalkylene resins, such as low-density polyethylenes, high-density polyalkylenes, polypropylene, and their blends are used. If required, for example, a brightening agent, an antioxidant, an antistatic agent, and a release agent are added.

For example, unsaturated organic compounds having one or more polymerizable carbon-carbon double bonds in the molecule, as described in JP-A Nos. 27257/1982, 49946/1982, and 262738/1986, and di-, tri- or tetra-acrylates represented by a general formula in JP-A Nos. 262738/1986 can be used. In this case, the resin is applied to a substrate and then is cured with irradiation with an electron ray to form a water-resistant resin layer. Titanium oxide and other white pigment is dispersed in this unsaturated organic compound. Other resin may also be mixed and titanium oxide and other white pigment are dispersed.

As the method for applying a water-resistant resin layer of the present invention, the lamination method described, for example, in *New Laminate Processing Handbook*, edited by Kakogijutsu Kenkyukai, such as dry lamination and solvent-free dry lamination are used, and for coating, for example, any of the gravure roll-type coating method, the wire bar-type coating method, the doctor blade-type coating method, the reverse roll coating method, the dip-type coating method, the air knife coating method, the calender coating-type method, the kiss-type coating method, the squeegee coating-type method, and the fountain type coating method can be chosen to be used.

Preferably the surface of the base is subjected to corona discharge treatment, glow discharge treatment, or flame treatment, and then protective colloid layers of the silver halide photographic material are provided.

Preferably, the overall basis weight of the base is 30 to 350 g/m$^2$ (about 30 to 400 μm), and more preferably about 50 to 200 g/m$^2$.

Herein the "optical reflection density" is measured by a reflection density meter usually used in this field and is defined as follows. However, when the measurement is carried out, a standard reflective plate is placed on the undersurface of the sample to prevent a measurement error due to light passing through the sample.

$$\text{Optical reflection density} = \log_{10}(F_0/F)$$

$F_0$: the reflected light flux of the standard white plate

F: the reflected light flux of the sample

Preferably the optical reflection density required in the present invention is 0.70 or over, more preferably 0.7 or over but 2.0 or below, still more preferably 0.8 or over but 1.9 or below, and most preferably of all 1.0 or over but 1.8 or below at the measurement wavelength of 680 nm. Preferably, the ratio of the optical reflection density at 550 nm to the optical reflection density at 680 nm is 1 or below, more preferably 0.8 or below, still more preferably 0.6 or below, and most preferably of all 0.5 or below but 0.2 or over. Further, preferably the optical reflection density at 470 nm is 0.2 or over and more preferably 0.3 or over.

To obtain the optical reflection density of the present invention, the amounts of dyes mentioned below to be added are controlled. These dyes may be used alone or in combination. There is no particular limitation as to which layer the dyes are added, and the dyes may be added, for example, to a layer between the lowermost photosensitive layer and the base, a photosensitive layer, an intermediate layer, a protective layer, or a layer between a protective layer and the uppermost photosensitive layer.

The dye to accomplish this purpose is selected from those that substantially do not spectrally sensitize silver halides.

To add these dyes, conventional techniques can be applied and, for example, the dye may first be dissolved in water or an alcohol, such as methanol, after which it is added.

The amounts of the dyes to be added may be decided using the following coating amounts as a guide.

Cyan dyes: 20 mg/m$^2$ to 100 mg/m$^2$ (the most preferable amount)

Magenta dyes:

0 to 50 mg/m$^2$ (a preferable amount)

0 to 10 mg/m$^2$ (the most preferable amount)

Yellow dyes:

0 to 30 mg/m$^2$ (a preferable amount)

5 to 20 mg/m$^2$ (the most preferable amount)

Preferably the dyes added to the above layers are present in a dispersed form in all the layers during the period from the application to the drying of the photographic material rather than that the dyes being in a fixed form a particular layer, because in the former case the effect of the present invention is made remarkable and an increase of the cost of the production by allowing the dyes to be present in a particular layer can be prevented.

As dyes that can be used in the present invention can be mentioned oxonol dyes having a pyrazolone nucleus or barbituric acid nucleus described, for example, in British Patent Nos. 506,385, 1,177,429, 1,311,884, 1,338,799, 1,385,371, 1,467,214, 1,1433,102, and 1,553,516, JP-A Nos. 85,130/1973, 114,420/1974, 117,123/1977, 161,233/1980, and 111,640/1984, JP-B Nos. 22,069/1964, 13,168/1968, and 273527/1987, and U.S. Pat. Nos. 3,247,127, 3,469,985, and 4,078,933, other oxonol dyes described, for example, in U.S. Pat. Nos. 2,533,472 and 3,379,533 and British Patent No. 1,278,621, azo dyes described, for example, in British Patent Nos. 575,691, 680,631, 599,623, 786,907, 907,125, and 1,045,609, U.S. Pat. No. 4,255,326, JP-A No. 211,043/1984, azomethine dyes described, for example, in JP-A Nos. 100,116/1975 and 118,247/1979 and British Patent Nos. 2,014,598 and 750,031, anthraquinone dyes described in U.S. Pat. No. 2,865,752, arylidene dyes described, for example, in U.S. Pat. Nos. 2,538,009, 2,688,541, and 2,538,008, British Patent Nos. 584,609 and 1,210,252, JP-A Nos. 40,625/1975, 3,623/1976, 10,927/1976, and 118,247/1979 and JP-B Nos. 3,286/1973 and 37,303/1984, styryl dyes described, for example, in JP-B Nos. 3,082/1953, 16,594/1969, and 28,898/1984, triarylmethane dyes described, for example, in British Patent Nos. 446,583 and 1,335,422 and JP-A No. 228,250/1984, merocyanine dyes described, for example, in British Patent Nos. 1,075,653, 1,153,341, 1,284,730, 1,475,228, and 1,542,807, and cyanine dyes described, for example, in U.S. Pat. Nos. 2,843,486 and 3,294,539.

Of these, dyes that can particularly preferably be used in the present invention are dyes represented by the following formulae (I), (II), (III), (IV), (V), or (VI):

Formula (I)

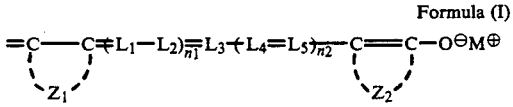

wherein $Z_1$ and $Z_2$, which may be the same or different, each represent a group of non-metallic atoms required for the formation of a heterocyclic ring, $L_1$, $L_2$, $L_3$, $L_4$, and $L_5$ each represent a methine group, $n_1$ and $N_2$ each are 0 or 1, and $M^{\oplus}$ represents a hydrogen cation or other monovalent cation.

Formula (II)

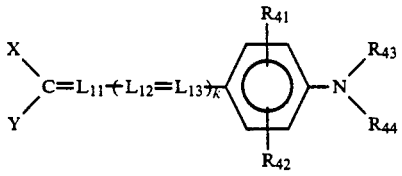

wherein

X and Y, which may be the same or different, each represent an electron-attractive group, and X and Y may bond together to form a ring, $R_{41}$ and $R_{42}$, which may be the same or different, each represent a hydrogen atom, a halogen atom, an alkyl group, an alkoxy group, a hydroxy group, a carboxyl group, a substituted amino group, a carbamoyl group, a sulfamoyl group, an alkoxycarbonyl group, or a sulfo group, $R_{43}$ and $R_{44}$, which may be the same or different, each represent a hydrogen atom, an alkyl group, an alkenyl group, an aryl group, an acyl group, or a sulfonyl group, and $R_{43}$ and $R_{44}$ may bond together to form a 5- to 6-membered ring, $R_{41}$ and $R_{43}$ may bond together to form a 5- to 6-membered ring, and $R_{42}$ and $R_{44}$ may bond together to from a 5- to 6-membered ring, at least one of X, Y, $R_{41}$, $R_{42}$, $R_{43}$, and $R_{44}$ has a sulfo group or a carboxyl group as a substituent, $L_{11}$, $L_{12}$, and $L_{13}$ each represent a methine group, and k is 0 or 1.

$Ar_1$-N=N-$Ar_2$ (Formula (III)

wherein $Ar_1$ and $Ar_2$, which may be the same or different, each represent an aryl group or a heterocyclic group, Formula (IV)

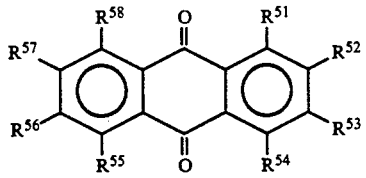

wherein $R^{51}$, $R^{54}$, $R^{55}$, and $R^{58}$, which may be the same or different, each represent a hydrogen atom, a hydroxy group, an alkoxy group, an aryloxy group, a carbamoyl group, or an amino group

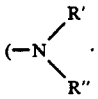

in which R' and R'', which may be the same or different, each represent a hydrogen atom or an alkyl group or an aryl group having at least one sulfonic acid group or a carboxyl group), and $R^{52}$, $R^{53}$, $R^{56}$, and $R^{57}$, which may be the same or different, each represent a hydrogen atom, a sulfonic acid group, a carboxyl group, or an alkyl or aryl group having at least one sulfonic acid group or carboxyl group.

Formula (V)

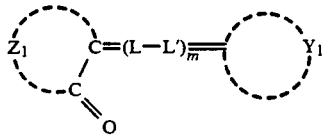

wherein

L and L' each represent a substituted or unsubstituted methine group or a nitrogen atom, m is 0, 1, 2, or 3, $Z_1$ represents a group of non-metallic atoms required for the formation of a pyrazolone nucleus, a hydroxypyridone nucleus, a barbituric acid nucleus, a thiobarbituric acid nucleus, a dimedone nucleus, an indan-1,3-dione nucleus, a rhodanine nucleus, a thiohydantoin nucleus, an oxazolidin-4-one-2-thion nucleus, a homophthalimido nucleus, a pyrimidin-2,4-dione nucleus, or a 1,2,3,4-tetrahydroquinolin-2,4-dione nucleus, and $Y_1$ represents a group of non-metallic atoms required for the formation of an oxazole nucleus, a benzooxazole nucleus, a naphthooxazole nucleus, a thiazole nucleus, a benzothiazole nucleus, a naphthothiazole nucleus, a benzoselenazole nucleus, a pyridine nucleus, a quinoline nucleus, a benzimidazole nucleus, a naphthoimidazole nucleus, an imidazoquinoline nucleus, an indolenine nucleus, an isooxazole nucleus, a benzoisooxazole nucleus, a naphthoisooxazole nucleus, or an acridine nucleus, and $Z_1$ and $Y_1$ may further have a substituent.

Formula (VI)

(A)

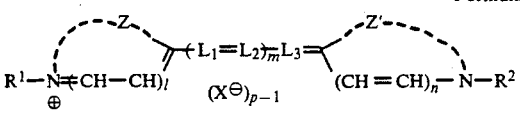

or (B)

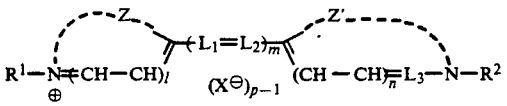

wherein $R^1$ and $R^2$, which may be the same or different, each represent a substituted or unsubstituted alkyl group, $L_1$, $L_2$, and $L_3$, which may be the same or different, each represent a substituted or unsubstituted methine group, and m is 0, 1, 2, or 3, Z and Z', which may be the same or different, each represent a group of non-metallic atoms required for the formation of a substituted or unsubstituted heterocyclic 5- or 6-membered ring, and l and n each are 0 or 1, and $X^{\ominus}$ represents an anion, p is 1 or 2, and when the compound forms an inner salt, p is 1.

Of the dyes represented by formula (I), particularly preferable dyes are those represented by the following formula (I-a):

Formula (I-a)

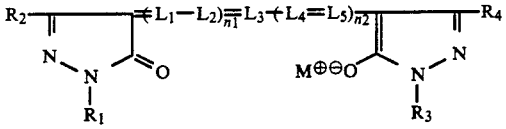

wherein $R_1$ and $R_3$ each represent an aliphatic group, an aromatic group, or a heterocyclic group, $R_2$ and $R_4$ each represent an aliphatic group, an aromatic group, $-OR_5$, $-COOR_5$, $-NR_5R_6$, $-CONR_5R_6$, $-NR_5CONR_5R_6$, $-SO_2R_7$, $-COR_7$, $-NR_6COR_7$, $-NR_6SO_2R_7$, or a cyano group in which $R_5$ and $R_6$ each represent a hydrogen atom, an aliphatic group, or an aromatic group, $R_7$ represents an aliphatic group or an aromatic group, and $R_5$ and $R_6$ or $R_6$ and $R_7$ may bond together to form a 5- or 6-membered ring, and $L_1$, $L_2$, $L_3$, $L_4$, $L_5$, $n_1$, $n_2$, and $M^{\oplus}$ have the same meanings as defined in formula (I).

Examples of the dye represented by formula (I-a) are listed below, but the present invention is not restricted to them.

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| a-1 | 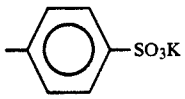 | $-CH_3$ | $=CH-$ | H |
| a-2 | 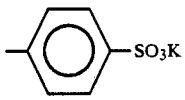 | $-CONHC_3H_7^{(n)}$ | $=CH-$ | H |
| a-3 | 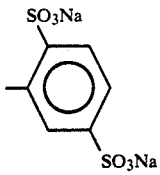 | $-OH$ | $=CH-CH=CH-$ | Na |
| a-4 | 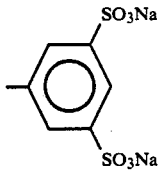 | $-OC_2H_5$ | $=CH-(CH=CH)_2$ | Na |
| a-5 | $-CH_2CH_2SO_3K$ | $-COOC_2H_5$ | $=CH-CH=CH-$ | H |
| a-6 | 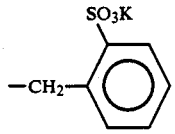 | $-CONHC_4H_9^{(n)}$ | $=CH-CH=CH-$ | H |
| a-7 | $-CH_2CH_2SO_3K$ | $-COOK$ | $=CH-(CH=CH)_2$ | H |

-continued

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| a-8 | 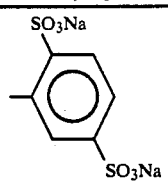 | $-COCH_3$ | $=CH\langle CH=CH\rangle_2$ | Na |
| a-9 | 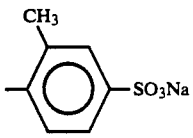 | $-CF_3$ | $=CH\langle CH=CH\rangle_2$ | H |
| a-10 | 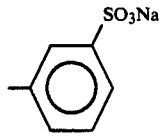 | $-NHCOCH_3$ | $=CH-CH=CH-$ | H |
| a-11 | 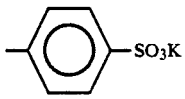 | $-COOC_2H_5$ | $=CH\langle CH=CH\rangle_2$ | H |
| a-12 | 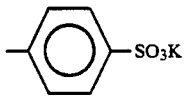 | $-COOK$ | $=CH-CH=CH-$ | H |
| a-13 | 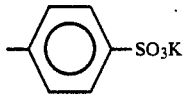 | $-NHCONHCH_3$ | $=CH-CH=CH-$ | H |
| a-15 | 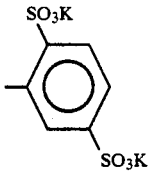 | $-COOK$ | $=CH-CH=CH-$ | K |
| a-16 | 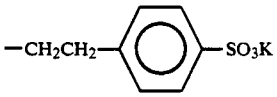 | $-C_6H_5$ | $=CH-CH=CH-$ | H |
| a-17 | 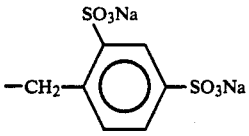 | $-COOC_2H_5$ | $=CH\langle CH=CH\rangle_2$ | Na |
| a-18 | 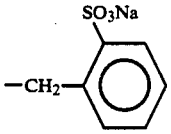 | $-CONHCH_2CH_2OH$ | $=CH\langle CH=CH\rangle_2$ | H |
| a-19 | 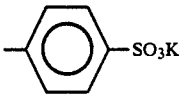 | $-CONHCH_2CH_2SO_3K$ | $=CH\langle CH=CH\rangle_2$ | H |
| a-20 | $-(CH_2)_3SO_3K$ | $-CONHC_7H_{15}^{(n)}$ | $=CH-CH=CH-$ | H |
| a-21 | $-CH_2COOK$ | $-COOK$ | $=CH-CH=CH-$ | K |
| a-22 | $-CH_2CH_2SO_3K$ | $-N(CH_3)_2$ | $=CH\langle CH=CH\rangle_2$ | H |
| a-23 | $-(CH_2)_3SO_3K$ | $-CN$ | $=CH\langle CH=CH\rangle_2$ | H |

-continued

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| a-24 | 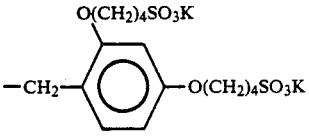 | $-CH_2Cl$ | $=CH\langle CH=CH\rangle_2$ | H |
| a-25 | $-(CH_2)_2SO_3Na$ | $-OH$ | $=CH\langle CH=CH\rangle_2$ | H |
| a-26 | 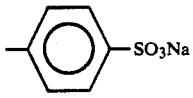 | $-CH_3$ | $=CH-\overset{CH_3}{\overset{\vert}{C}}=CH-$ | Na |
| a-27 | 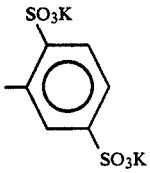 | $-COOC_2H_5$ | $=CH\langle CH=CH\rangle_2$ | H |
| a-28 | 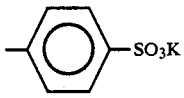 | $-CONHC_2H_5$ | $=CH-CH=CH-$ | H |
| a-29 | 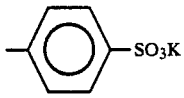 | $-NHCOC_3H_7^{(i)}$ | $=CH-CH=CH-$ | H |
| a-30 | $-CH_2CH_2SO_3K$ | 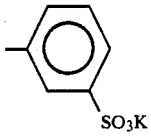 | $=CH-CH=CH-$ | H |
| a-31 | 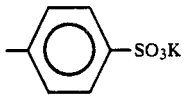 | $-CH_3$ | $=\overset{CH_3}{\overset{\vert}{C}}-CH=CH-$ | H |
| a-32 | 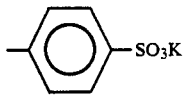 | $-{}^{t}C_4H_9$ | $=CH-CH=CH-$ | H |
| a-33 | 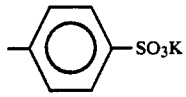 | $-CN$ | $=CH\langle CH=CH\rangle_2$ | H |
| a-34 | 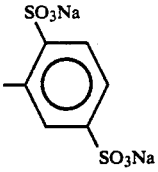 | $-COCH_3$ | $=CH-CH=\overset{CH_3}{\overset{\vert}{C}}-CH=CH-$ | Na |
| a-35 | 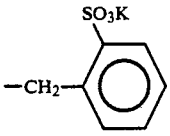 | $-COOK$ | $=CH\langle CH=CH\rangle_2$ | H |

-continued

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| a-36 | 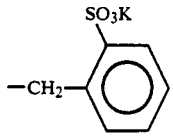 | $-COOK$ | $=CH-CH=CH-$ | H |
| a-37 | 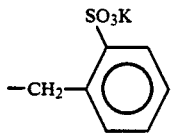 | $-CONHC_4H_9^{(i)}$ | $=CH\leftarrow CH=CH\rightarrow_2$ | H |
| a-38 | 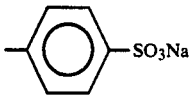 | $-NHSO_2CH_3$ | $=CH\leftarrow CH=CH\rightarrow_2$ | H |
| a-39 | 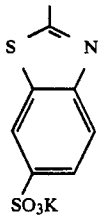 | $-CN$ | $=CH\leftarrow CH=CH\rightarrow_2$ | H |
| a-40 | 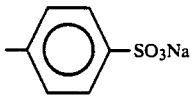 | $-OC_2H_5$ | $=CH\leftarrow CH=CH\rightarrow_2$ | H |
| a-41 | 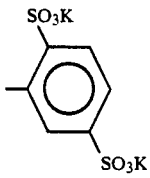 | $-CN$ | $=CH\leftarrow CH=CH\rightarrow_2$ | H |

As dyes represented by formulae (I) to (VI) to be used in the present invention, those described in JP-A No. 297213/1989, pages 27 to 103, can be used.

The dyes used in the present invention dissolve out from the silver halide photographic material in one of steps from the development to the washing or are decolored with a sulfite, as described in British Patent No. 506,385.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called color couplers capable of forming dyes complementary to light to which the couplers are respectively sensitive, that is, capable of forming yellow complementary to blue, magenta complementary to green, and cyan complementary to red.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 $\mu$m.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in *Heterocyclic Compounds—Cyanine Dyes and Related Compounds* (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), (M-II), and (Y):

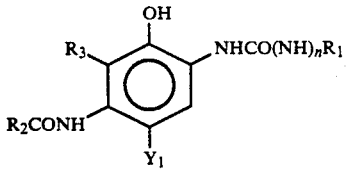

Formula (C-I)

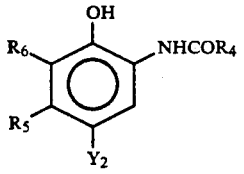

Formula (C-II)

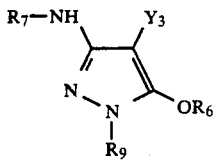

Formula (M-I)

-continued

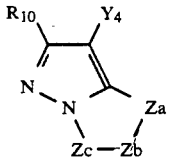

Formula (M-II)

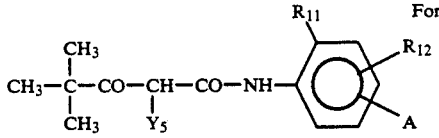

Formula (Y)

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za-Zb bond and the Zb-Zc bond is a double bond, and the other is a single bond. If the Zb-Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents $—NHCOR_{13}$, $—NHSO_2—R_3$, $—SO_2NHR_{13}$, $—COOR_{13}$, or $$-SO_2\underset{\underset{R_{14}}{|}}{N}-R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

(C-1)
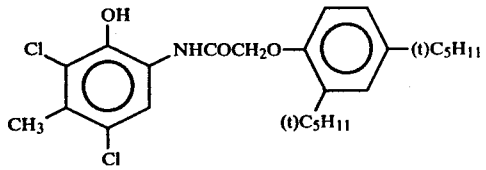
(C-2)
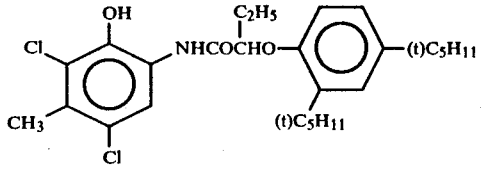
(C-3)
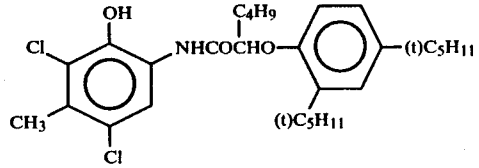
(C-4)
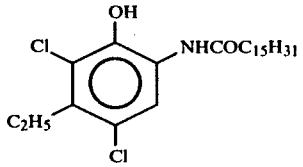
(C-5)
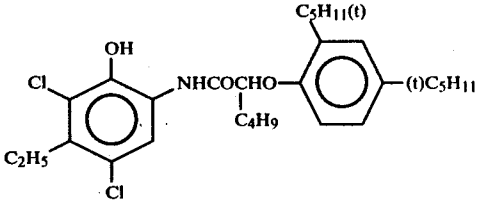
(C-6)
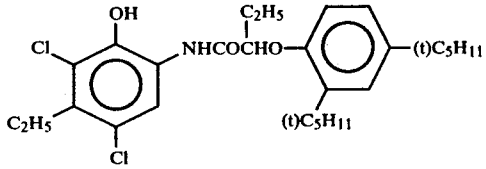
(C-7)
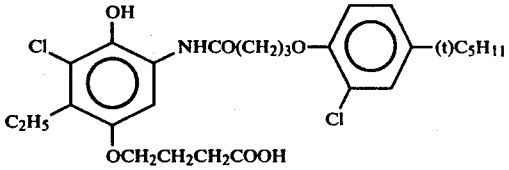
(C-8)
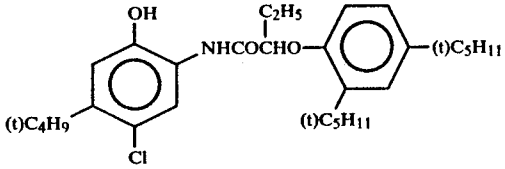
(C-9)
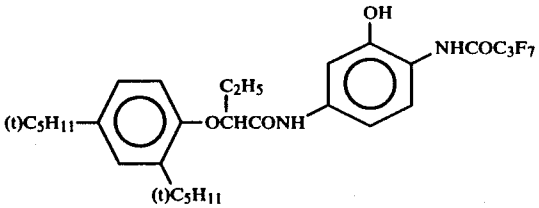
(C-10)
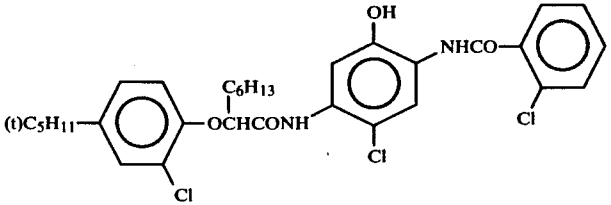

-continued
(C-11)
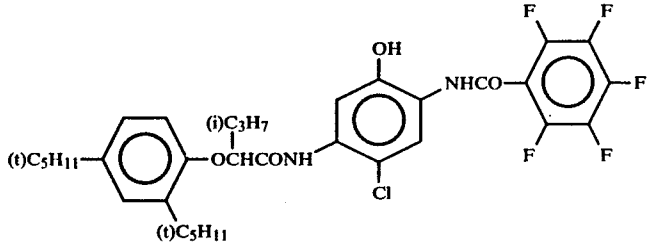
(C-12)
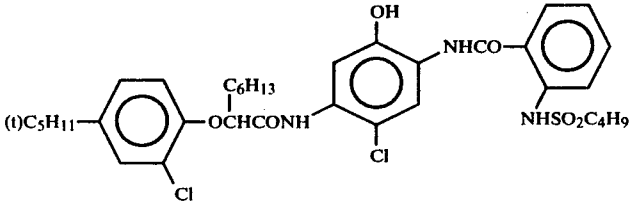
(C-13)
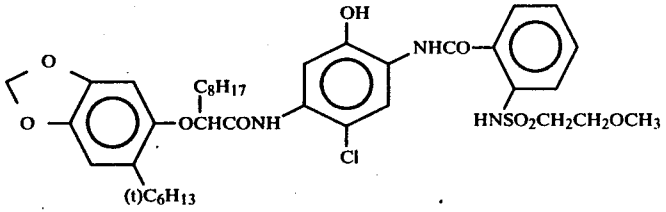
(C-14)
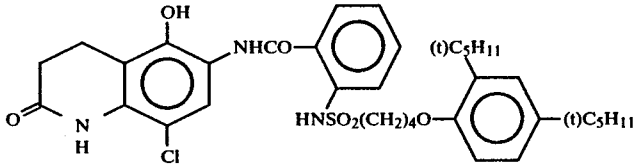
(C-15)
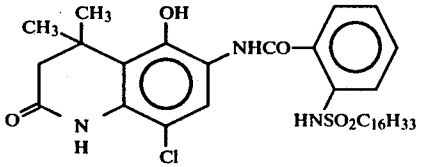
(C-16)
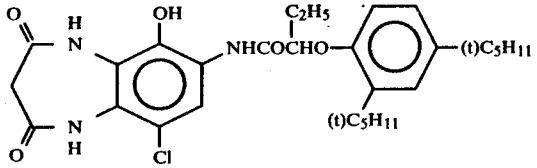
(C-17)
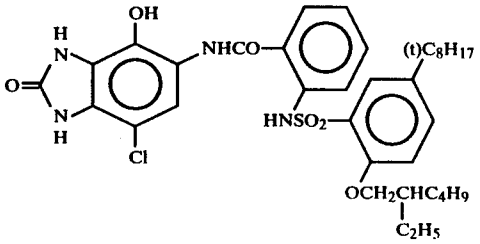
(C-18)
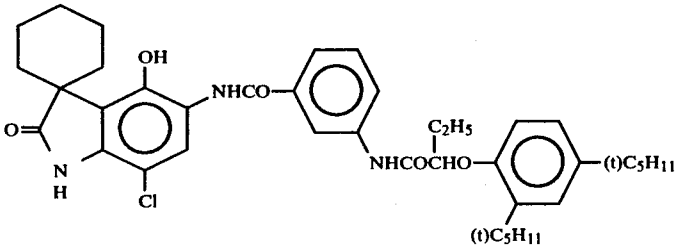

-continued
(C-19)
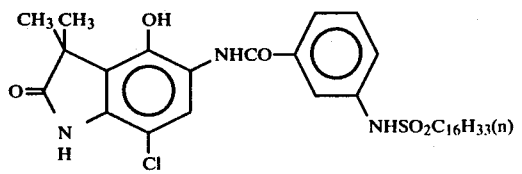
(C-20)
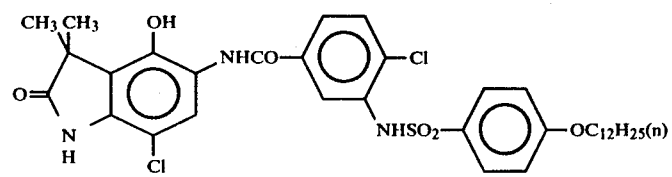
(C-21)
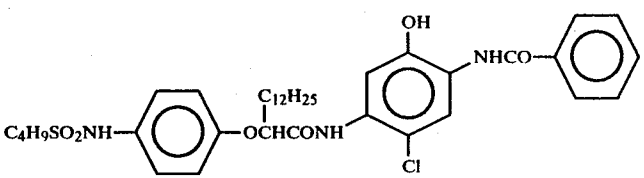
(C-22)
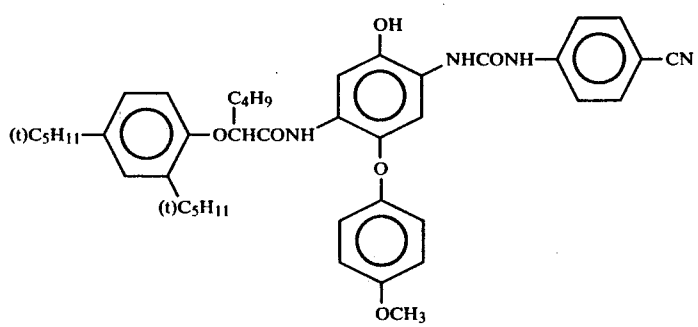
(M-1)
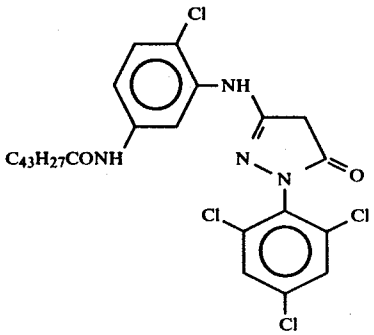
(M-2)
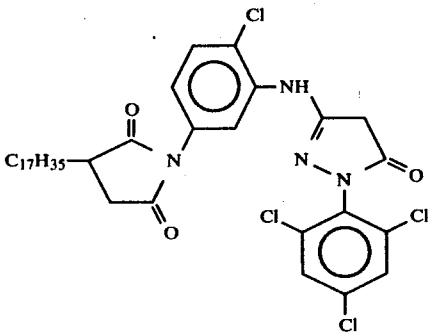

-continued
(M-3)
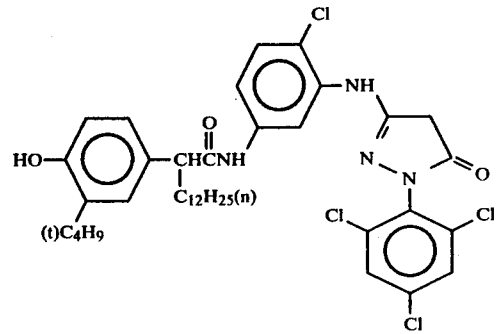
(M-4)
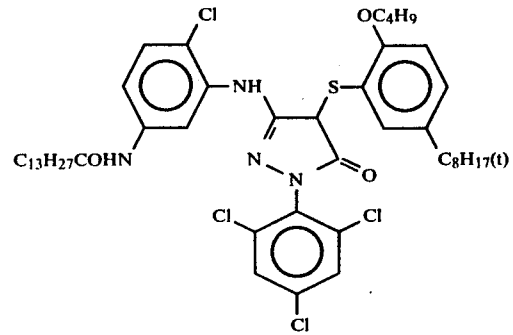
(M-5)
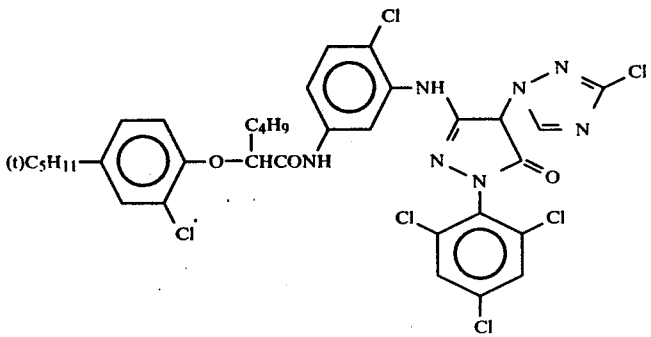
(M-6)
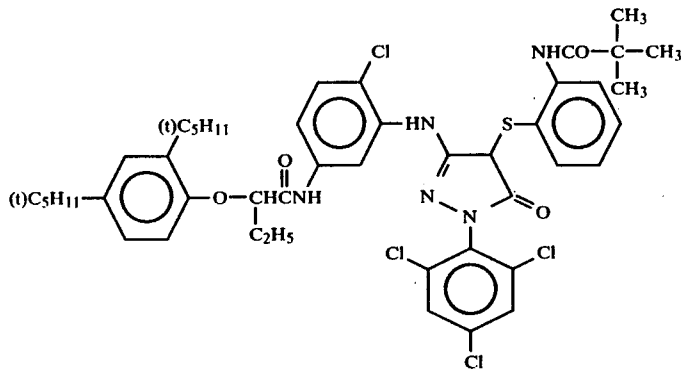
(M-7)
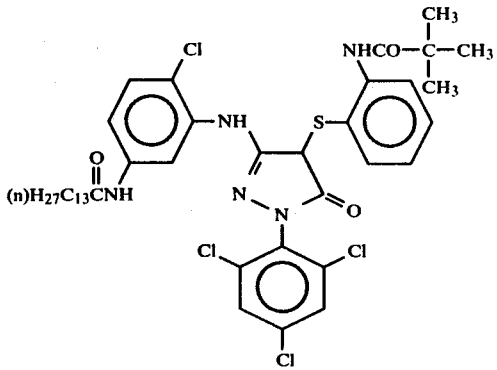
(M-8)
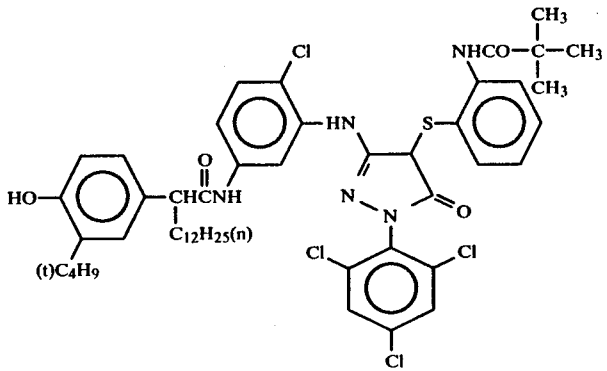

-continued
| Compound | $R_{10}$ | $R_{15}$ | $Y_4$ |
|---|---|---|---|
| | | 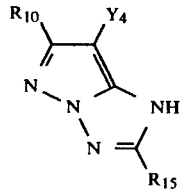 | |
| M-9 | $CH_3$— | 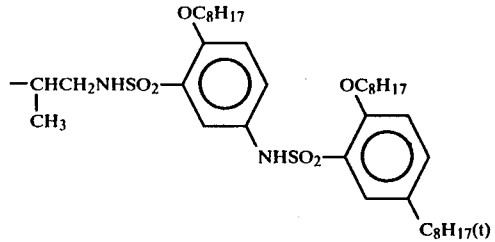 | Cl |
| M-10 | The same as the above | 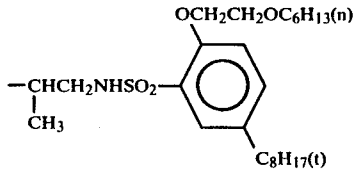 | The same as the above |
| M-11 | $(CH_3)_3C$— | 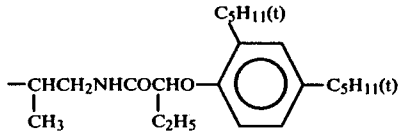 | 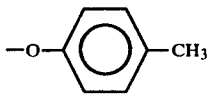 |
| M-12 | 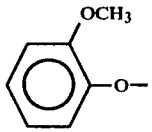 | 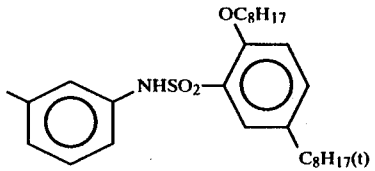 | 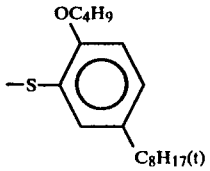 |

-continued
| | | | |
|---|---|---|---|
| M-13 | $CH_3$— | 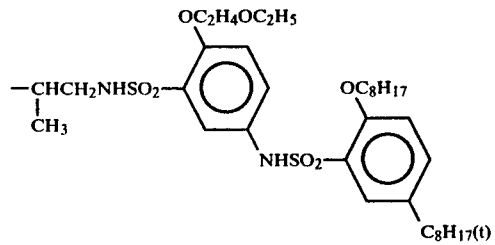 | Cl |
| M-14 | The same as the above | 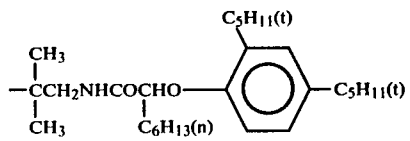 | The same as the above |
| M-15 | The same as the above | 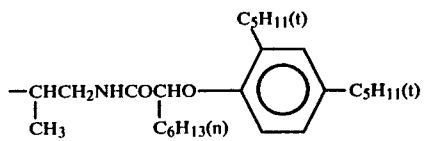 | The same as the above |
| M-16 | The same as the above | 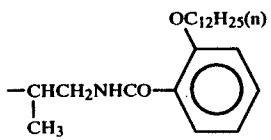 | The same as the above |
| M-17 | The same as the above | 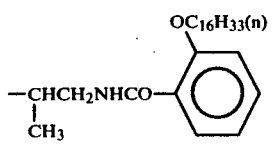 | The same as the above |

-continued
| | | | |
|---|---|---|---|
| M-18 | 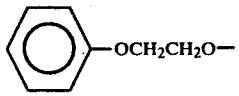 | 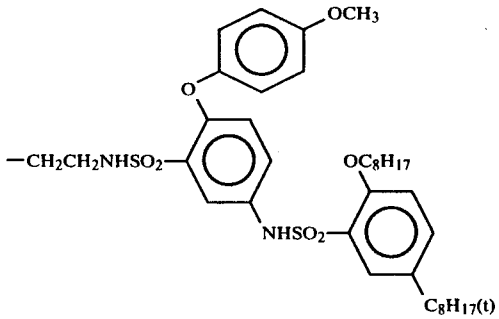 | 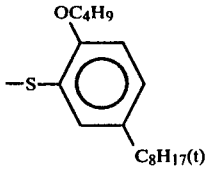 |
| M-19 | $CH_3CH_2O-$ | The same as the above | The same as the above |
| M-20 | 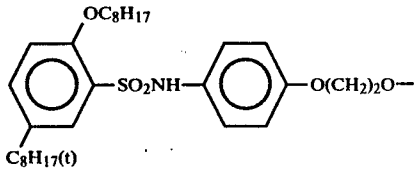 | 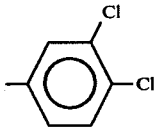 | 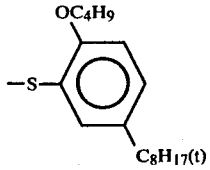 |
| M-21 | 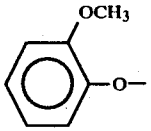 | 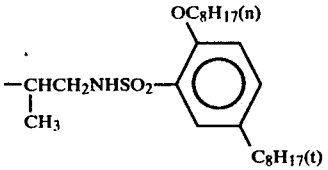 | Cl |
| M-22 | $CH_3-$ | 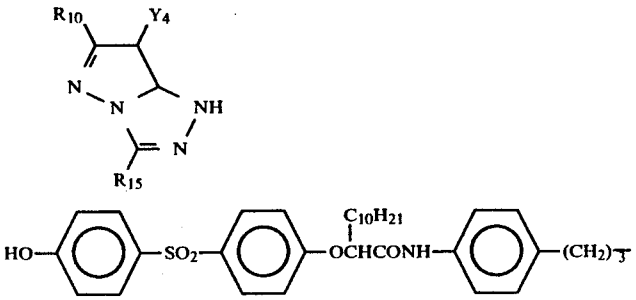 | Cl |

-continued
| | | | |
|---|---|---|---|
| M-23 | The same as the above | 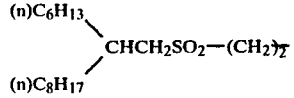 | The same as the above |
| M-24 | 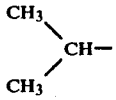 | 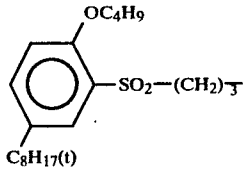 | The same as the above |
| M-25 | 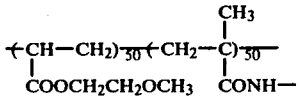 | 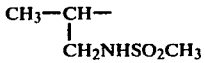 | The same as the above |
| M-26 | 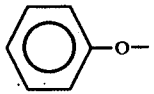 | 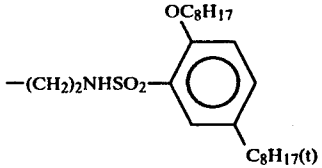 | The same as the above |
| M-27 | $CH_3$— | 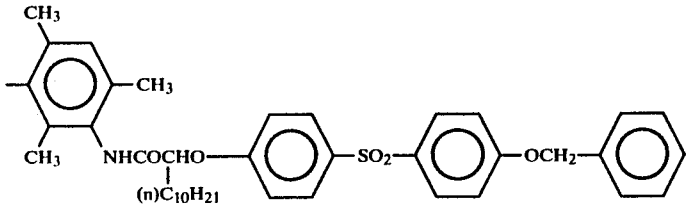 | Cl |
| M-28 | $(CH_3)_3C$— | 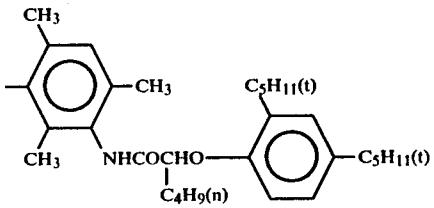 | The same as the above |

-continued
| | | | |
|---|---|---|---|
| M-29 | 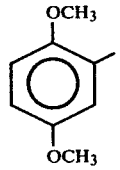 | 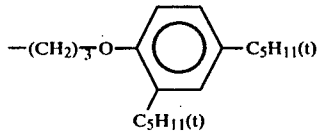 | The same as the above |
| M-30 | $CH_3-$ | 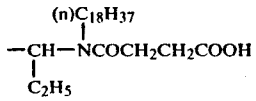 | The same as the above |
(Y-1)
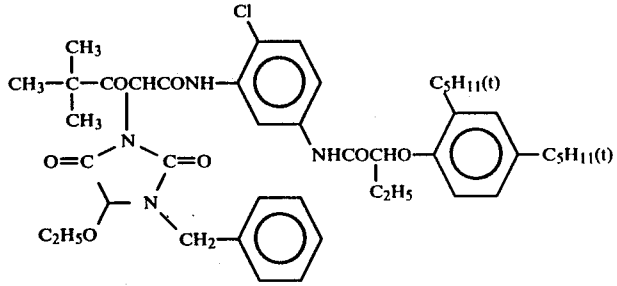
(Y-2)
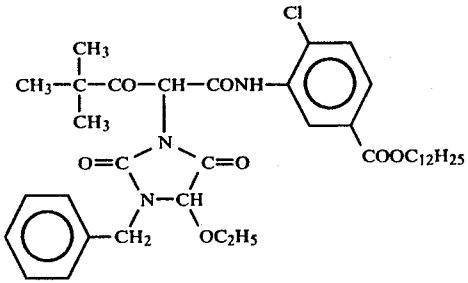
(Y-3)
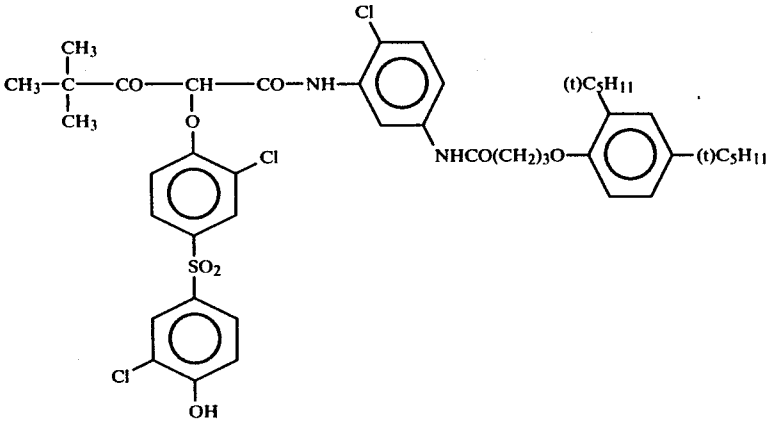

-continued
(Y-4)
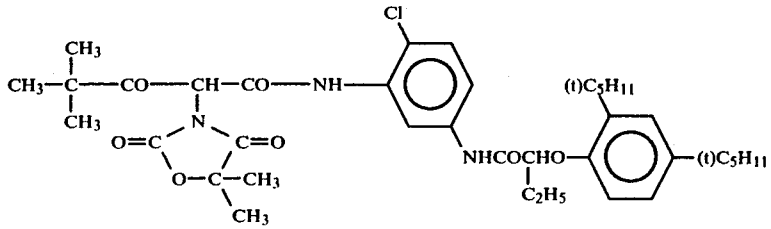
(Y-5)
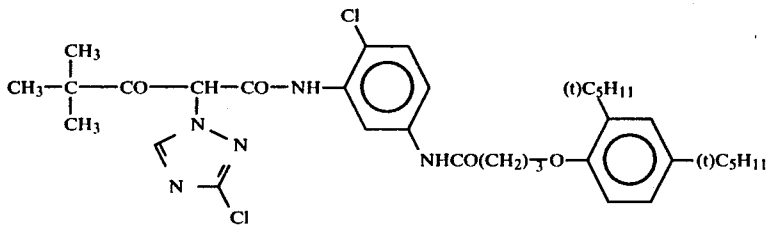
(Y-6)
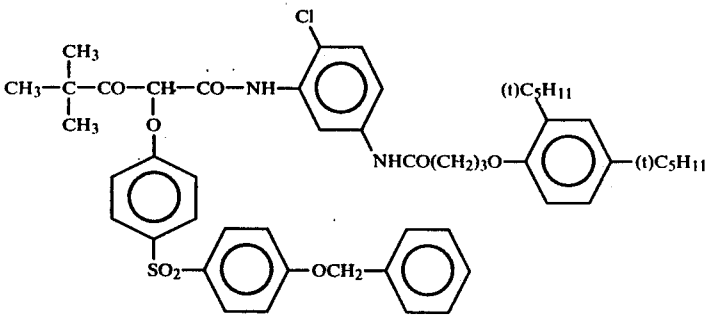
(Y-7)
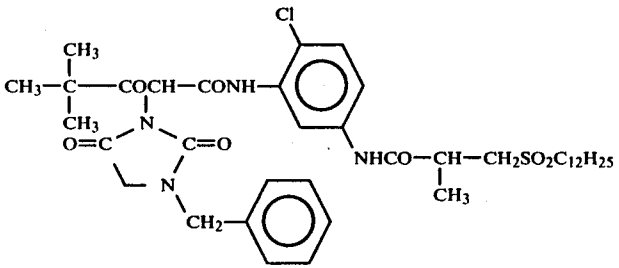
(Y-8)
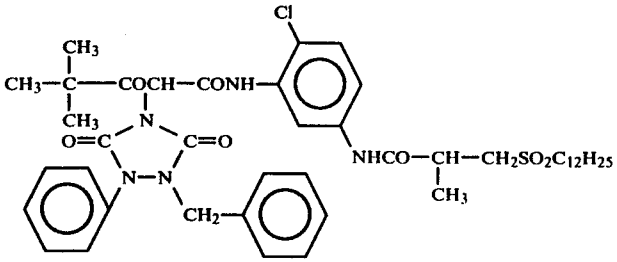
(Y-9)
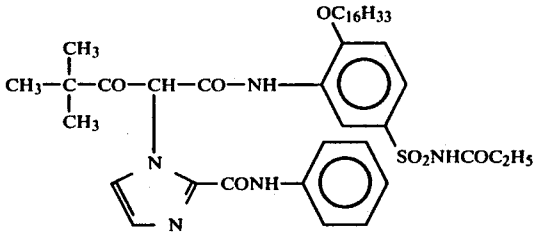

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C'), (D'), or (E') is preferably used.

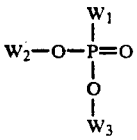

Formula (A')

$W_1-COOW_2$ Formula (B')

$W_1-CON\begin{matrix}W_2\\W_3\end{matrix}$ Formula (C')

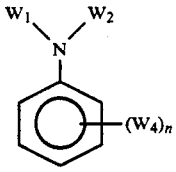

Formula (D')

$W_1-O-W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S-W_1$, n is an integer of 1 to 5, when n is 2 or over, $W_4$ groups may be the same or different, and in formula (E,), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic antifading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt% for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S Pat. No. 4,045,229), or benzoxazole compounds 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 1/mol.sec to $1\times10^{-5}$ 1/mol.sec. The second-order reaction- specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

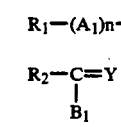

$$R_1-(A_1)n-X \qquad \text{Formula (FI)}$$

$$R_2-\underset{\underset{B_1}{|}}{C}=Y \qquad \text{Formula (FII)}$$

wherein $R_1$ and $R_2$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_1$ and X, or Y and $R_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

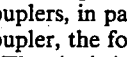

$$R_3\text{-}Z \qquad \text{(Formula GI)}$$

wherein $R_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application No. 136724/1988, and European Published Patent Nos. 298321 and 277589.

Details of combinations of compound (G) and compound (F) are described in European Published Patent No. 277589.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

It is preferable that the present color photographic material is color-developed, bleach-fixed, and washed (or stabilized). The bleach and the fixing may not be effected in the single bath described above, but may be effected separately.

For the reduction of edge stain and the improvement of sharpness, the color developer of the present invention contains chloride ions in an amount of 0.035 to 0.3 mol/1, more preferably 0.005 to 0.15 mol/1. These chloride ions ma be added into a processing solution or may dissolve from the photosensitive material so as to get the above-described concentration.

In the present invention, the color developer contains bromide ions preferably in an amount of $3.0\times10^{-5}$ to $1.0\times10^{-3}$ mol/1 for the purpose of improvement of sharpness. More preferably bromide ions are contained in an amount $5.0\times10^{-5}$ to $5.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, the effect is not obtained sufficiently.

Herein, chloride ions and bromide ions may be added directly to the developer, or they may be allowed to dissolve out from the photographic material in the developing process.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5 2-methyl-4-[N-ethyl-N-(β-hydroxyethyl-)amino]aniline
D-6: 4-amino-3-methyl-N-ethyl-N-[β-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0\times10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0\times10^{-3}$ mol/l or below, and most preferably hydroxylamine is not contained at all.

It is preferable that the developer used in the present invention contains an organic preservative instead of hydroxylamine or sulfite ions, above-mentioned.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting its stability improvement during the continuous processing.

As the example of the above-mentioned amines cyclic amines described, for example, in JP-A No. 239447/1988, amines described, for example, in JP-A No. 128340/1988, and amines described, for example, in Japanese Patent Application Nos. 9713/1988 and 11300/1988.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 30° to 40° C. The processing time is 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step—a fixing step; a fixing step—a bleach-fixing step; a bleaching step—a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III)

(e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and Research Disclosure No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8- octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, antifoaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku,* (1986) published by Sankyo-Shuppan, *Biseibutsu no Genkin, Sakkin, Bobai Gijutsu* (1982), edited by Eiseigijutsu-kai published by Kogyo-Gijutsu kai, and in *Bokin Bobai-zai Jiten* (1986) edited by Nihon Bokin Bobai-gakkai, can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization.

The pH of the washing step or a stabilizing step is preferably 4 to 10, more preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

The preferable replenishing amount per unit area of photographic material is 0.5 to 50 times, more preferably 3 to 40 times amount of solution carried over from the preceding bath. In other words, it is 1 liter or below, preferably 500 ml or below, per square meter of photographic material. The replenishing may be carried out continuously or intermittently.

Solutions which used in washing process and/or stabilizing process can be used further in preceding process. Of this example it can be mentioned that the overflow of washing water which reduced by multi-stage counter current system is introduced to the preceding bleach-fixing bath and a concentrated solution is replenished into the bleach-fixing bath to reduce the waste solution.

Next, the present invention will be described in detail in accordance with examples, but the invention is not limited to these Examples.

EXAMPLE 1

Resin layer having the composition given below and containing a white pigment comprising water-resistant titanium dioxide was provided on white raw paper to produce the bases given below. The white raw paper comprises 100% of bleached hardwood sulfate pulp, and has a basis weight of 175 g/m$^2$ and a thickness of about 180 μm.

Base I:

10 pts wt. of white pigment, anatase titanium oxide, whose particle surface was treated as shown below, was added to 90 pts wt. of a polyethylene composition (density: 0.920 g/cm$^3$; melt index (MI): 5.0 g/10 min), then they were kneaded and a water-resistant resin layer having a thickness of 30 μm was obtained by melt extrusion coating.

Titanium oxide powder was immersed in an ethanol solution of 2,4-dihydroxy-2-methylpentane and the mixture was heated to evaporate the ethanol, to obtain titanium oxide white pigment whose particle surface had been treated. The alcohol covered the particle surface in an amount of about 1 wt. % based on the titanium oxide. The water-resistant resin layer comprising the polyethylene composition was provided on the undersurface of white raw paper.

The same procedure was repeated, except that the amount of the titanium oxide was varied as shown in Table 1, thereby obtainging Samples II to V.

TABLE 1

| Base No. | Concentration of titanium oxide | Film thickness |
|---|---|---|
| II | 13 pts. wt. | 30 μm |
| III | 14 pts. wt. | 30 μm |
| IV | 15 pts. wt. | 30 μm |
| V | 20 pts. wt. | 30 μm |

The thus prepared reflective bases were subjected to corona discharge treatment and a gelatin undercoat was provided on each of the bases. Layers shown below were applied to each of the bases to prepare multilayer color photographic papers. The coating liquids were prepared as shown below.

Preparation of the First Layer Coating Solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.3 mol % of silver bromide was located at the surface of grains), and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution.

As a gelatin hardener for the respective layers, 1-oxy-3,5-dichloro-s-triazine sodium salt was used. Hexachloroiridum(IV) potassium was added to each emulsion at the formation of emulsion. Amounts added were same to the large size emulsion and to the small size emulsion, and $1\times10^{-7}$ mol, $3\times10^{-7}$ mol, $5\times10^{-7}$ mol, per mol of silver, were added to the blue-sensitive emulsion layer, green-sensitive emulsion layer, and red-sensitive emulsion layer, respectively.

As spectral-sensitizing dyes for the respective layers, the following compounds were used as CR-compound at the formation of localized phase: Blue-sensitive emulsion layer:

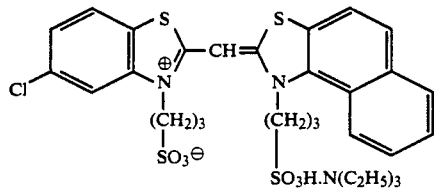

and

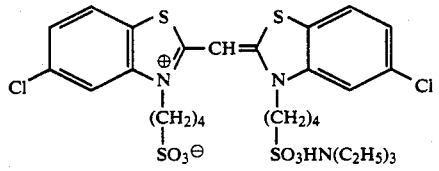

(each $2.0\times10^{-4}$ mol to the large size emulsion $2.5\times10^{-4}$ mol to the small size emulsion, per mol of silver halide.)

Green-sensitive emulsion layer:

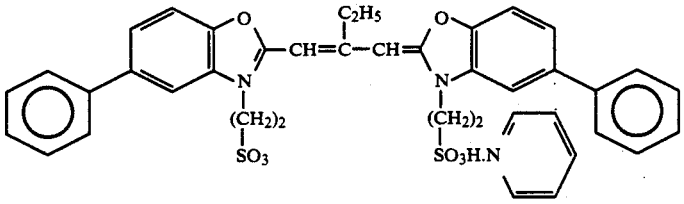

($4.0\times10^{-4}$ mol to the large size emulsion and $5.6\times10^{-4}$ mol to the small size emulsion, per mol of silver halide) and

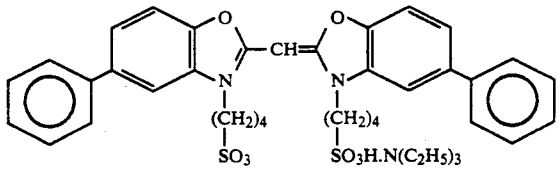

($7.0\times10^{-5}$ mol to the large size emulsion and $1.0\times10^{-5}$ mol to the small size emulsion, per mol of silver halide)

Red-sensitive emulsion layer:

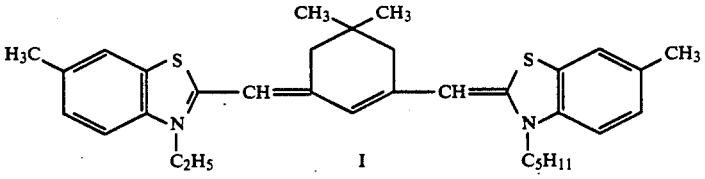

I ($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

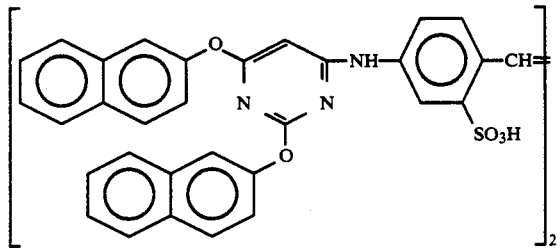

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxyl-6-methyl-1,3a,7-tetrazaindene was added to the blue-sensitive emulsion layer and the green-sensitive emulsion layer in amount of $1\times10^{-4}$ mol and $2\times10^{31\ 4}$ mol, per mol of silver halide, respectively.

The dyes shown below were added to respective layers for prevention (each figure represents a coating amount):

Blue-sensitive emulsion layer (Yellow dye)

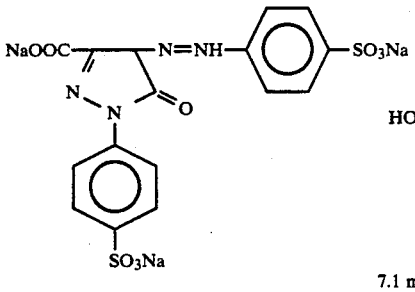

7.1 mg/m²

Green-sensitive emulsion layer (magenta dye)

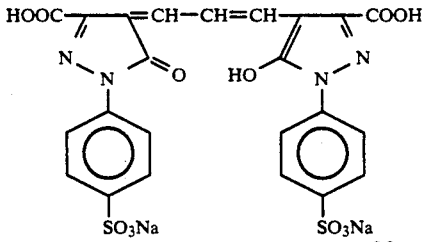

5.0 mg/m²

Red-sensitive emulsion layer mixture (5:2 in weight ratio) of Cyan dye I

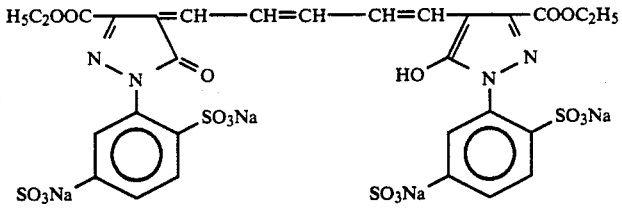

and Cyan dye II

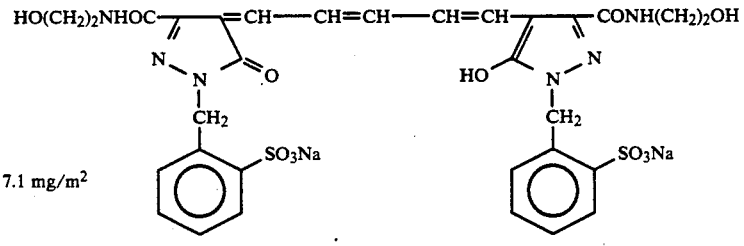

Further, the following compounds were used as a antiseptics (each figure represents a coating amount).

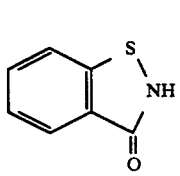

(25.0 mg/m²)

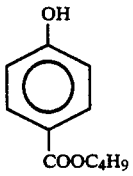

(50.0 mg/m²)

Composition of Layers

The composition of each layer is shown below. The figures represent coating amount (g/m²). The coating amount of each silver halide emulsion is given in terms of silver.

First Layer (Blue-sensitive emulsion layer):

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |

-continued

| | |
|---|---|
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.60 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

R = 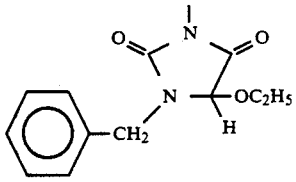 and R = 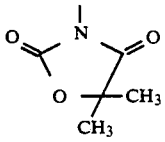

of the following formula

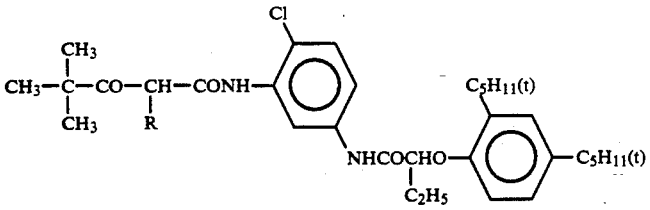

(ExM) Magenta coupler

Mixture (1:1 in molar ratio) of

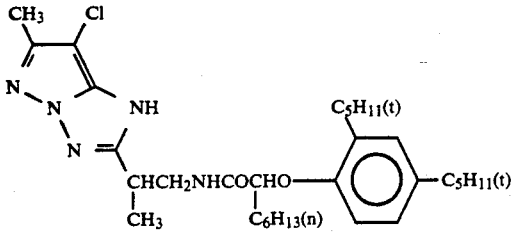

and

-continued
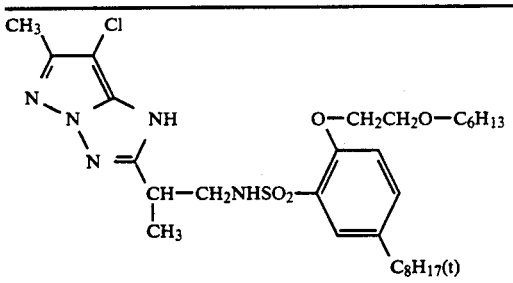
(ExC) Cyan coupler
Mixture (2:4:4 in weight ratio) of
R = $C_2H_5$ and $C_4H_9$ of
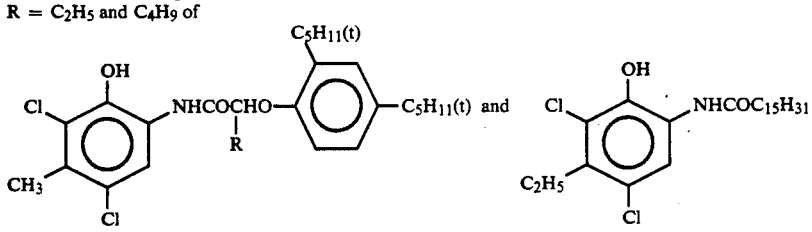
(Cpd-1) Image-dye stabilizer
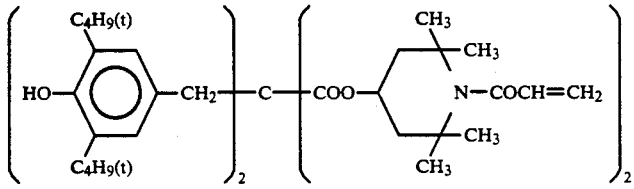
(Cpd-2) Image-dye stabilizer
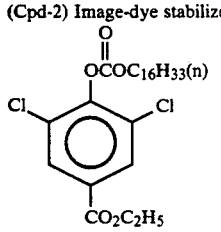
(Cpd-3) Image-dye stabilizer
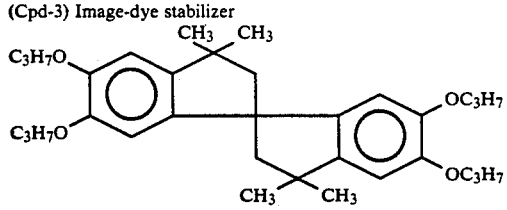
(Cpd-4) Image-dye stabilizer
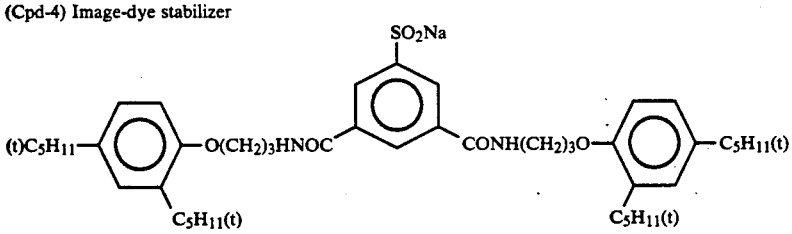
(Cpd-5) Color-mix inhibitor
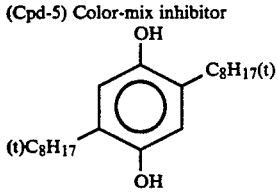

-continued
(Cpd-6) Image-dye stabilizer
Mixture (2:4:4 in weight ratio) of
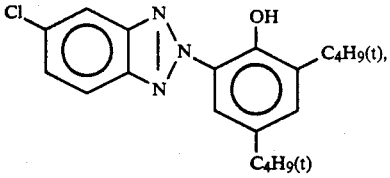
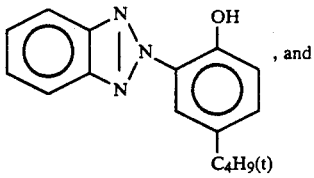
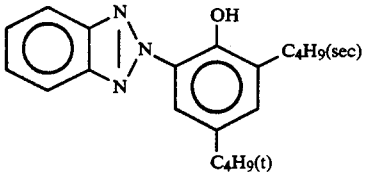
(Cpd-7) Image-dye stabilizer
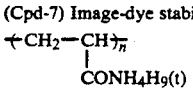
Average molecular weight: 60,000
(Cpd-8) Image-dye stabilizer
Mixture (1:1) of
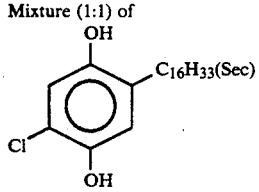
and
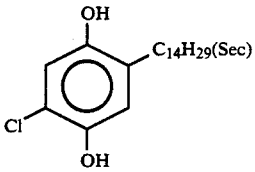
(Cpd-9) Image-dye stabilizer
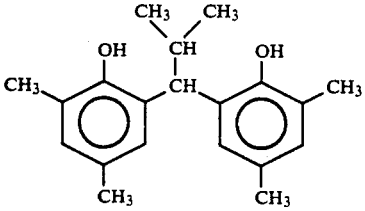
(UV-1) Ultraviolet ray absorber
Mixture (4:2:4 in weight ratio) of
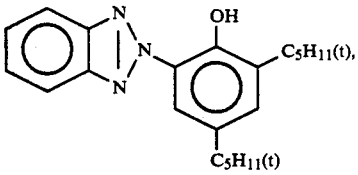
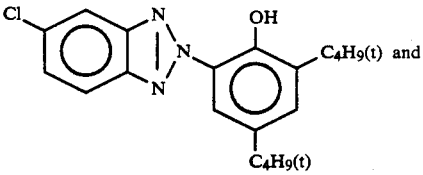
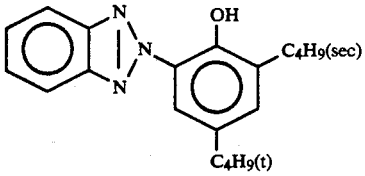
(Solv-1) Solvent
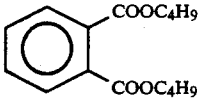
(Solv-2) Solvent
Mixture (2:1 in volume ratio) of -continued

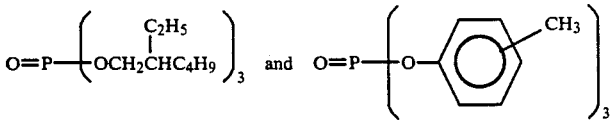

(Solv-4) Solvent

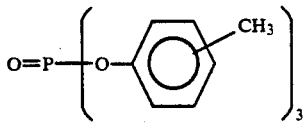

(Solv-5) Solvent (Solv-6) Solvent
Mixture (95:5 in volume) of

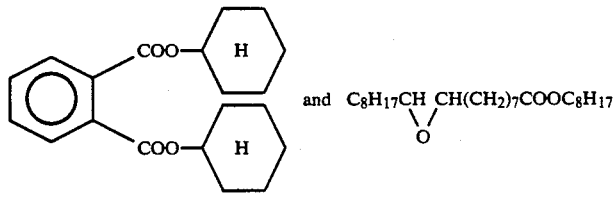

Next, samples 1-1 to 1-14 were prepared by changing the coating amounts of cyan dyes I and II for irradiation prevention to be added to the base and the red-sensitive emulsion layer and by changing reflection density at 680 nm. Details are shown in Table 1.

Thus-prepared samples were subjected to an exposure to light through an wedge and then to processing process shown below in which the concentration of chloride ions and bromide ions in color developer were changed as shown in Table 1.

| Processing process | Temperature (°C.) | Time (sec.) |
|---|---|---|
| Color developing | 38 | 45 |
| Bleach-fixing | 30–35 | 45 |
| Rinsing 1 | 30–35 | 20 |
| Rinsing 2 | 30–35 | 20 |
| Rinsing 3 | 30–35 | 20 |
| Drying | 70–80 | 60 |

Compositions of respective processing solutions are as follows:

| | Tank Solution |
|---|---|
| Color developer | |
| Water | 800 ml |
| Nitrilo-N,N,N'-trimethylene phosphonic acid (40%) | 8.5 ml |
| 1-Hydroxyethylidene-1,1-diphosphonic acid (60%) | 1.0 ml |
| Diethylenetriamineheptaacetic acid | 1.0 g |
| Potassium bromide | see Table 1 |
| Sodium chloride | see Table 1 |
| Triethanolamine | 8.0 g |
| Potassium chloride | 1.4 g |
| Potassium carbonate | 25 g |

-continued

| | Tank Solution |
|---|---|
| N-ethyl-N-(β-methanesulfonamidoethyl)-3-methyl-4-aminoaniline sulfate | 5.0 g |
| Diethylhydroxylamine | 5.5 g |
| Fluorescent brightening agent (4,4'-diamino-stilbene series) | 1.0 g |
| Water to make | 1,000 ml |
| pH (25° C.) | 10.10 |
| Bleach-fixing solution | |
| Water | 400 ml |
| Ammonium thiosulfate (70%) | 100 ml |
| Sodium sulfite | 17 g |
| Fe(III) ammonium ethylenediamine-tetraacetate | 55 g |
| Disodium ethylenediaminetetraacetate | 5 g |
| Ammonium bromide | 40 g |
| Water to make | 1,000 ml |
| pH (25° C.) | 6.0 |

RINSING SOLUTION

Ion-Exchanged Water (Concentration of Calcium and magnesium each are 3 ppm or below)

To assess the edge stain, 30 sheets of each processed Sample were stuck with the cut ends registered, the yellow density of the cut ends was measured by a Macbeth densitometer, and after they were aged for 6 days at 80° C./70% RH, the yellow density was again measured to find the increase in the yellow density ($\Delta D_B$). The rectangular chart for checking the sharpness was exposed to light by using an enlarger and the above processing was carried out to find the CTF value (a relative value of the density difference of fine lines at the time when the density difference at 0.21 line/mm was assumed 1) at the point of 5 line/mm. The results are summarized in Table 1.

TABLE 1

| No. | Sample | Base | Titanium Oxide (wt. %) | Reflection Density (680 nm) | Remarks |
|---|---|---|---|---|---|
| 1 | 1-1 | I | 10 | 0.60 | Comparative Example |
| 2 | 1-2 | I | " | 1.02 | " |
| 3 | 1-3 | II | 13 | 0.63 | " |
| 4 | 1-4 | II | " | 1.08 | " |
| 5 | 1-5 | III | 14 | 0.67 | This Invention |
| 6 | 1-6 | III | " | 0.78 | " |
| 7 | 1-7 | III | " | 1.02 | " |
| 8 | 1-8 | III | " | 1.83 | " |
| 9 | 1-9 | III | " | 2.01 | " |
| 10 | 1-10 | IV | 15 | 0.66 | " |
| 11 | 1-11 | IV | " | 1.07 | " |
| 12 | 1-12 | IV | " | 1.54 | " |
| 13 | 1-13 | V | 20 | 0.62 | " |
| 14 | 1-14 | V | " | 1.09 | " |

| | Cl ions (mol/l) | | | | | | | | | | | | | |
|---|---|---|---|---|---|---|---|---|---|---|---|---|---|---|
| | 0.030 | | 0.035 | | 0.050 | | 0.050 | | 0.050 | | 0.30 | | 0.35 | |
| | Br ions (mol/l) | | | | | | | | | | | | | |
| | — | | — | | — | | $1.2 \times 10^{-4}$ | | $2.5 \times 10^{-4}$ | | — | | — | |
| No. | $\Delta D_B$ | CTF | $\Delta D_B$ | CTF | $\Delta D_B$ | CTF | $\Delta D_B$ | CTF | $\Delta D_B$ | CTF | $\Delta D_B$ | CTF | $\Delta D_B$ | CTF |
| 1 | 0.19 | 0.53 | 0.19 | 0.53 | 0.19 | 0.53 | 0.19 | 0.54 | 0.19 | 0.54 | 0.19 | 0.53 | 0.19 | 0.53 |
| 2 | 0.19 | 0.54 | 0.19 | 0.54 | 0.19 | 0.54 | 0.19 | 0.54 | 0.19 | 0.54 | 0.19 | 0.54 | 0.19 | 0.54 |
| 3 | 0.18 | 0.54 | 0.18 | 0.54 | 0.18 | 0.54 | 0.18 | 0.55 | 0.18 | 0.55 | 0.18 | 0.54 | 0.18 | 0.54 |
| 4 | 0.18 | 0.56 | 0.18 | 0.57 | 0.18 | 0.57 | 0.18 | 0.57 | 0.18 | 0.57 | 0.18 | 0.56 | 0.18 | 0.56 |
| 5 | 0.18 | 0.62 | 0.15 | 0.68 | 0.15 | 0.69 | 0.14 | 0.75 | 0.14 | 0.76 | 0.15 | 0.68 | 0.18 | 0.60 |
| 6 | 0.18 | 0.63 | 0.15 | 0.70 | 0.15 | 0.71 | 0.14 | 0.76 | 0.14 | 0.77 | 0.15 | 0.71 | 0.18 | 0.61 |
| 7 | 0.18 | 0.64 | 0.14 | 0.73 | 0.14 | 0.75 | 0.13 | 0.78 | 0.13 | 0.78 | 0.14 | 0.72 | 0.18 | 0.62 |
| 8 | 0.18 | 0.64 | 0.14 | 0.73 | 0.14 | 0.75 | 0.13 | 0.77 | 0.13 | 0.77 | 0.14 | 0.71 | 0.18 | 0.61 |
| 9 | 0.18 | 0.63 | 0.15 | 0.72 | 0.15 | 0.74 | 0.13 | 0.74 | 0.14 | 0.75 | 0.15 | 0.72 | 0.18 | 0.62 |
| 10 | 0.18 | 0.63 | 0.15 | 0.69 | 0.15 | 0.71 | 0.14 | 0.75 | 0.14 | 0.75 | 0.15 | 0.70 | 0.18 | 0.62 |
| 11 | 0.18 | 0.64 | 0.15 | 0.70 | 0.15 | 0.75 | 0.14 | 0.77 | 0.14 | 0.77 | 0.15 | 0.70 | 0.18 | 0.61 |
| 12 | 0.18 | 0.64 | 0.15 | 0.69 | 0.15 | 0.74 | 0.14 | 0.76 | 0.14 | 0.76 | 0.15 | 0.70 | 0.18 | 0.61 |
| 13 | 0.18 | 0.64 | 0.15 | 0.69 | 0.15 | 0.73 | 0.15 | 0.75 | 0.15 | 0.75 | 0.15 | 0.70 | 0.18 | 0.60 |
| 14 | 0.18 | 0.65 | 0.15 | 0.69 | 0.15 | 0.73 | 0.15 | 0.75 | 0.15 | 0.75 | 0.15 | 0.70 | 0.18 | 0.60 |

Note:

[ ] designates results of this invention

The amount of titanium oxide was increased and the chlorine ion concentration in the color developer was kept in a certain range. According to the present invention, it can be concluded that coloring of edge parts due to aging is made better, edge stain is decreased, the CTF sharpness value is increased, and sharpness is improved.

EXAMPLE 2

Samples 1-2, 4, 7, and 11 each were subjected to an exposure to light wedgewise and then a processing prices shown below until the replenishing amount reached to twice the volume of tank of color developer.

| Processing process | Temperature (°C.) | Time (sec.) | Replenishing Amount* | Tank Volume |
|---|---|---|---|---|
| Color developing | 38 | 45 | 72 ml | 17 l |
| Bleach-fixing | 30-35 | 45 | 60 ml | 17 l |
| Rinsing (1) | 30-35 | 20 | — | 10 l |
| Rinsing (2) | 30-35 | 20 | — | 10 l |
| Rinsing (3) | 30-35 | 20 | — | 10 l |
| Rinsing (4) | 30-35 | 20 | 200 ml | 10 l |
| Drying | 70-80 | 60 | | |

Note: *Replenishing amount per $m^2$ of photographic paper Rinsing processes were carried out in 4-tanks counter-current flow mode from the tank of rinsing (4) toward the tank of rinsing (1).

Compositions of each processing solution is as follows:

| | Tank Solution | Replenisher |
|---|---|---|
| Color developer | | |
| Water | 800 ml | 800 ml |
| 1-Hydroxyethylidene-1,1-diphosphonic acid (60%) | 1.0 g | 1.0 g |
| Diethylenetriamine-heptaacetic acid | 1.0 g | 1.0 g |
| Nitrilotrimethylene phosphonic acid (40%) | 7.0 g | 7.0 g |
| Potassium bromide | 0.02 g | — |
| Triethanolamine | 8.0 g | 12.0 g |
| Sodium chloride | 4.0 g | — |
| Potassium carbonate | 25 g | 25 g |
| N-ethyl-N-(β-methane-sulfonamidoethyl)-3-methyl-4-aminoaniline sulfate | 5.0 g | 11.0 g |
| N,N-bis(carboxymethyl)hydrazine | 5.5 g | 9.0 g |
| Fluorescent brightening agent (WHITEX 4B, prepared by Sumitomo Chemical Ind.) | 1.0 g | 3.0 g |
| Water to make | 1,000 ml | 1,000 ml |
| pH (25° C.) | 10.05 | 10.75 |
| Bleach-fixing solution | | |
| Water | 400 ml | 400 ml |
| Ammonium thiosulfate (70%) | 100 ml | 200 ml |
| Sodium sulfite | 17 g | 34 g |
| Fe(III) ammonium ethylenediamine-tetraacetate | 55 g | 110 g |
| Disodium ethylenediamine-tetraacetate | 5 g | 10 g |
| Water to make | 1,000 ml | 1,000 ml |
| pH (25° C.) | 6.0 | 4.7 |
| Rinsing solution (Both tank solution and replenisher) | | |

-continued

| | Tank Solution | Replenisher |
|---|---|---|
| Ion-exchanged water (concentrations of calcium and magnesium were both 3 ppm or below) | | |

At the end of the above-described continuous processing, concentrations of chloride ions and bromide ions in each four color developer were measured to obtain the results shown in Table 2.

At this condition, samples were treated to evaluate edge stain and sharpness. Results are shown in Table 2.

TABLE 2

| | Color developer | | Results | | |
|---|---|---|---|---|---|
| Sample | Cl ions (mol/l) | Br ions (mol/l) | Edge Stain ($\Delta D_B$) | CTF Sharpness | Remarks |
| 1-2 | 0.080 | $2.1 \times 10^{-4}$ | 0.21 | 0.52 | Comparative Example |
| 1-4 | 0.079 | $2.0 \times 10^{-4}$ | 0.16 | 0.72 | This Invention |
| 1-7 | 0.081 | $2.2 \times 10^{-4}$ | 0.16 | 0.72 | " |
| 1-11 | 0.080 | $2.1 \times 10^{-4}$ | 0.16 | 0.70 | " |

As is apparent from the results in Table 2, edge stain was remarkably improved and sharpness was enhanced according to the present invention.

Having described out invention as related to the embodiment, it is out intention that the invention be not limited in any of the details of the description, unless otherwise specified, but rather be construed broadly within its spirit and scope as set out in the accompanying claims.

What we claim is:

1. A method for processing a silver halide color photographic material having at least one silver halide photosensitive layer on a reflective base whose substrate is coated with a water-resistant resin layer, which comprises processing the silver halide color photographic material containing titanium oxide particles in a concentration of 14 wt. % or more in the water-resistant resin layer on the side where the silver halide photosensitive layer is applied, with a color developer containing chloride ions in an amount of 0.035 to 0.3 mol/l.

2. The method for processing a silver halide color photographic material as claimed in claim 1, wherein the optical reflection density of the unexposed and unprocessed silver halide photographic material is 0.70 or over at a measurement wavelength of 680 nm.

3. The method for processing a silver halide color photographic material as claimed in claim 1, wherein the titanium oxide particles are contained in a concentration of 15 to 60 wt. %.

4. The method for processing a silver halide color photographic material as claimed in claim 1, wherein the titanium oxide particles have been surface treated with a divalent to tetravalent alcohol.

5. The method for processing a silver halide color photographic material as claimed in claim 1, wherein the thickness of the water resistant resin layer is 2 to 200 μm.

6. The method for processing a silver halide color photographic material as claimed in claim 1, wherein the water resistant resin layer containing titanium oxide fine particles is laminated together with at least one water resistant resin layer that contains other white pigment or does not contain white pigment.

7. The method for processing a silver halide color photographic material as claimed in claim 1, wherein the deviation coefficient of the occupation area ratio of the titanium oxide particles is 0.20 or below.

8. The method for processing a silver halide color photographic material as claimed in claim 1, wherein the white base of the silver halide color photographic material is selected from the group consisting of raw papers obtained from a natural pulp or a synthetic pulp or a mixture thereof and plastic films.

9. The method for processing a silver halide color photographic material as claimed in claim 1, wherein the water-resistant resin is one having a water absorption rate of 0.5 wt. % or below.

10. The method for processing a silver halide color photographic material as claimed in claim 1, wherein the water-resistant resin is selected from the group consisting of polyalkylenes, vinyl polymers and their copolymers, and polyesters and their copolymers.

11. The method for processing a silver halide color photographic material as claimed in claim 1, wherein the overall basis weight of the base is 30 to 350 g/m$^2$.

12. The method for processing a silver halide color photographic material as claimed in claim 1, wherein the optical reflection density of the unexposed and unprocessed silver halide photographic material is 0.70 to 2.0 at a measurement wavelength of 680 nm.

13. The method for processing a silver halide color photographic material as claimed in claim 1, wherein the ratio of optical reflection density at 550 nm to optical reflection density at 680 nm is 1 or below.

14. The method for processing a silver halide color photographic material as claimed in claim 1, wherein the optical reflection density at 470 nm is 0.2 or over.

15. The method for processing a silver halide color photographic material as claimed in claim 1, wherein a dye selected from dyes represented by the following formulae (I), (II), (III), (IV), (V), and (VI) is used in the silver halide color photographic material:

Formula (I)

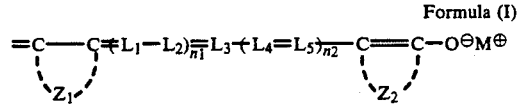

wherein $Z_1$ and $Z_2$ each represent a group of non-metallic atoms required for the formation of a heterocyclic ring, $L_1$, $L_2$, $L_3$, $L_4$, and $L_5$ each represent a methine group, $n_1$ and $n_2$ each are 0 or 1, and $M^{\oplus}$ represents a hydrogen cation or other monovalent cation, Formula (II)

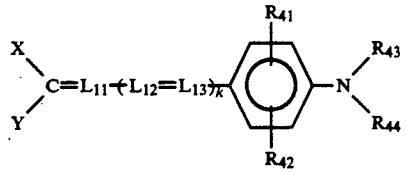

wherein

X and Y each represent an electron-attractive group, and X and Y may bond together to form a ring, $R_{41}$ and $R_{42}$ each represent a hydrogen atom, a halogen atom, an alkyl group, an alkoxy group, a hydroxyl group, a carboxyl group, a substituted amino group, a carbamoyl group, a sulfamoyl group, an alkoxycarbonyl group, or a sulfo group, $R_{43}$ and $R_{44}$ each represent a hydrogen atom, an alkyl group, an alkenyl group, an aryl group, an acyl group, or a sulfonyl group, and $R_{43}$ and $R_{44}$ may bond together to form a 5- to 6-membered ring, $R_{41}$ and $R_{43}$ may bond together to form a 5- to 6-membered ring, and $R_{42}$ and $R_{44}$ may bond together to from a 5- to 6-membered ring, at least one of X, Y, $R_{41}$, $R_{42}$, $R_{43}$, and $R_{44}$ has a sulfo group or a carboxyl group as a substituent, $L_{11}$, $L_{12}$, and $L_{13}$ each represent a methine group, and k is 0 or 1, $Ar_1$-N=N-$Ar_2$ (Formula (III)

wherein $Ar_1$ and $Ar_2$ each represent an aryl group or a heterocyclic group,

Formula (IV)

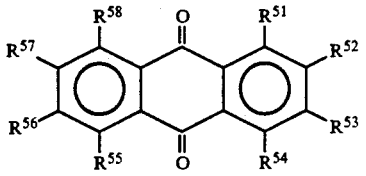

wherein $R^{51}$, $R^{54}$, $R^{55}$, and $R^{58}$ each represent a hydrogen atom, a hydroxyl group, an alkoxy group, an aryloxy group, a carbamoyl group, or an amino group

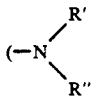

in which R' and R'', which may be the same or different, each represent a hydrogen atom or an alkyl group or an aryl group having at least one sulfonic acid group or a carboxyl group), and $R^{52}$, $R^{53}$, $R^{56}$, and $R^{57}$, which may be the same or different, each represent a hydrogen atom, a sulfonic acid group, a carboxyl group, or an alkyl or aryl group having at least one sulfonic acid group or carboxyl group, Formula (V)

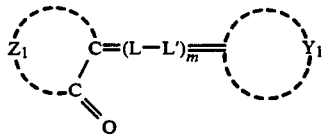

wherein

L and L' each represent a methine group or a nitrogen atom, m is 0, 1, 2, or 3, $Z_1$ represents a group of non-metallic atoms required for the formation of a pyrazolone nucleus, a hydroxypyridone nucleus, a barbituric acid nucleus, a thiobarbituric acid nucleus, a dimedone nucleus, an indan-1,3-dione nucleus, a rhodanine nucleus, a thiohydantoin nucleus, an oxazolidin-4-one-2-thion nucleus, a homophthalimido nucleus, a pyrimidin-2,4-dione nucleus, or a 1,2,3,4-tetrahydroquinolin-2,4-dione nucleus, and $Y_1$ represents a group of non-metallic atoms required for the formation of an oxazole nucleus, a benzooxazole nucleus, a naphthooxazole nucleus, a thiazole nucleus, a benzothiazole nucleus, a naphthothiazole nucleus, a benzoselenazole nucleus, a pyridine nucleus, a quinoline nucleus, a benzimidazole nucleus, a naphthoimidazole nucleus, an imidazoquinoline nucleus, an indolenine nucleus, an isooxazole nucleus, a benzoisooxazole nucleus, a naphthoisooxazole nucleus, or an acridine nucleus, and $Z_1$ and $Y_1$ may further have a substituent, Formula (VI) (A)

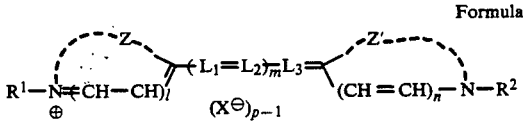

or (B)

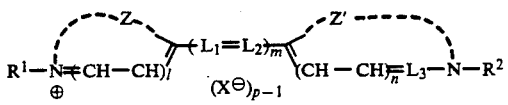

wherein $R^1$ and $R^2$ each represent a substituted or unsubstituted alkyl group, $L_1$, $L_2$, and $L_3$, which may be the same or different, each represent a substituted or unsubstituted methine group, and m is 0, 1, 2, or 3, Z and Z', which may be the same or different, each represent a group of non-metallic atoms required for the formation of a substituted or unsubstituted heterocyclic 5- or 6-membered ring, and l and n each are 0 or 1, and $X^{\ominus}$ represents an anion, p is 1 or 2, and when the compound forms an inner salt, p is 1.

16. The method for processing a silver halide color photographic material as claimed in claim 1, wherein a dye selected from dyes represented by the following formula (I-a) is used in the silver halide color photographic material:

Formula (I-a)

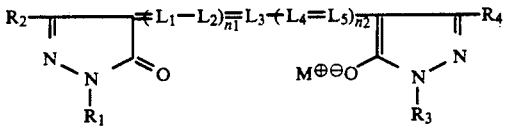

wherein $R_1$ and $R_3$ each represent an aliphatic group, an aromatic group, or a heterocyclic group, $R_2$ and $R_4$ each represent an aliphatic group, an aromatic group, $-OR_5$, $-COOR_5$, $-NR_5R_6$, $-CONR_5R_6$, $-NR_5CONR_5R_6$, $-SO_2R_7$, $-COR_7$, $-NR_6COR_7$, $-NR_6SO_2R_7$, or a cyano group in which $R_5$ and $R_6$ each represent a hydrogen atom, an aliphatic group, or an aromatic group, $R_7$ represents an aliphatic group or an aromatic group, and $R_5$ and $R_6$ or $R_6$ and $R_7$ may bond together to form a 5- or 6-membered ring, $L_1$, $L_2$, $L_3$, $L_4$, and $L_5$ each represent a methine group, $n_1$ and $n_2$ each are 0 or 1, and $M^{\oplus}$ represents a hydrogen cation or other monovalent cation.

17. The method for processing a silver halide color photographic material as claimed in claim 1, wherein the color developer further contains bromide ions in an amount of $3.0\times10^{-5}$ to $1.0\times10^{-3}$ mol/l.

* * * * *